US006623102B2

(12) United States Patent
Sanada et al.

(10) Patent No.: US 6,623,102 B2
(45) Date of Patent: Sep. 23, 2003

(54) LIQUID DISCHARGE RECORDING HEAD, SURFACE MODIFYING METHOD FOR INNER FACE OF LIQUID DISCHARGE HEAD, AND METHOD FOR MANUFACTURING LIQUID DISCHARGE HEAD

(75) Inventors: Mikio Sanada, Kanagawa (JP); Sadayuki Sugama, Ibaraki (JP); Hiroki Hayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 09/985,714

(22) Filed: Nov. 6, 2001

(65) Prior Publication Data

US 2002/0122095 A1 Sep. 5, 2002

(30) Foreign Application Priority Data

Nov. 8, 2000 (JP) ..... 2000-340641

(51) Int. Cl.[7] ..... B41J 2/135
(52) U.S. Cl. ..... 347/45
(58) Field of Search ..... 347/45; 427/372.2, 427/387, 230, 430.1

(56) References Cited

U.S. PATENT DOCUMENTS 4,313,124 A 1/1982 Hara
4,345,262 A 8/1982 Shirato et al.
4,399,193 A * 8/1983 Preiner et al. ..... 428/447
4,459,600 A 7/1984 Sato et al.
4,463,359 A 7/1984 Ayata et al.
4,558,333 A 12/1985 Sugitani et al.
4,723,129 A 2/1988 Endo et al.
4,740,796 A 4/1988 Endo et al.

FOREIGN PATENT DOCUMENTS

| | | |
|---|---|---|
| EP | 0 893 264 A2 | 1/1999 |
| JP | 59-123670 | 7/1984 |
| JP | 59-138461 | 8/1984 |
| JP | 11-345628 | 12/1999 |

* cited by examiner

*Primary Examiner*—Judy Nguyen
*Assistant Examiner*—Michael S Brooke
(74) *Attorney, Agent, or Firm*—Fitzpatrick, Cella, Harper & Scinto

(57) ABSTRACT

A liquid discharge head that records by discharging recording liquid is provided with polymer having a first portion with lyophilic group for lyophilic processing on a partial surface formed at least on a part of the inner face having recording liquid internally filled to be in contact therewith, and a second portion with a group having substantially the same or the same interfacial energy as the surface energy of the partial surface but different from the interfacial energy of the lyophilic group, while the second portion being orientated toward the partial surface, and the first portion being orientated in the direction different from the partial surface. With the structure thus arranged, the surface energy of the inner face of the liquid discharge head is essentially uniformalized, hence preventing air accumulation from being generated in the portion having lower surface energy.

9 Claims, 15 Drawing Sheets

LIQUID DISCHARGE RECORDING HEAD, SURFACE MODIFYING METHOD FOR INNER FACE OF LIQUID DISCHARGE HEAD, AND METHOD FOR MANUFACTURING LIQUID DISCHARGE HEAD

BACKGROUND OF THE INVENTION

1. Field of the Invention

The present invention relates to a liquid discharge head that records by discharging recording liquid, and also, to a method for manufacturing a liquid discharge head. More particularly, the invention relates to a liquid discharge head to which recording liquid is supplied, and the inner surface of which is made lyophilic. The invention also relates to a surface modifying method of the inner face of the liquid discharge head, as well as to a method for manufacturing such liquid discharge head. In this respect, the liquid discharge head of the present invention is applicable not only to a general printing apparatus, but also, to apparatuses such as a copying machine, a facsimile equipment provided with communication systems, and a word processor provided with a printing unit, among some others. Further, the invention is applicable to a recording apparatus for industrial use, which is complexly combined with various kinds of processing apparatuses.

2. Related Background Art

The liquid discharge apparatus (ink jet recording apparatus) is a recording apparatus of the so-called non-impact type, which is characterized by its capability of recording on a recording medium of various kinds at high speed with almost no noise in recording. With such advantages, the liquid discharge apparatus is widely adopted as the one that bears recording mechanism for a printer, a copying machine, a facsimile equipment, or the like.

As the typical liquid discharge method of a liquid discharge head mounted on a liquid discharge apparatus of the kind, there is known the one that used electro-mechanical converting member, such as piezoelectric element, the one that irradiates laser or some other electromagnetic waves to generate heat for discharging liquid by the action of this heating, or the one that heats liquid by use of the electrothermal converting member, which is provided with heat generating resistive element, and discharges liquid droplets by the action of film boiling, among some others. For the liquid discharge head that uses the electrothermal converting member as the discharge energy generating element, the electrothermal converting member is arranged in liquid flow path. The electric pulse that serves as recording signal is supplied thereto for heating and providing thermal energy for ink. Then, by the utilization of bubbling pressure at the time of liquid bubbling (at the time of film boiling) generated by phasic changes of liquid at that time, fine liquid droplets are discharged from each of the fine discharge ports for the performance of recording on a recording medium. Generally, there are provided the discharge ports for discharging liquid droplets, and a supply system that supplies ink to the discharge ports.

A liquid discharge head of the kind is generally formed by bonding plural members. In other words, the head is structured, for example, by a heater board having a plurality of electrothermal converting members arranged thereon, the common liquid chamber, which is bonded on the heater board, for inducing recording liquid from outside to that bonding surface, and a ceiling plate having a plurality of liquid flow paths formed to communicate with the discharge ports through above each of the electrothermal converting members. Further, an orifice plate having a plurality of discharge ports, which are open thereon corresponding to the discharge ports, may be prepared as a separate member in some cases, and bonded together with the heater board and the ceiling plate so as to position the discharge ports at each end of the liquid flow paths, respectively.

For such ceiling place and orifice plate, it is preferable to use polysulfone, epoxy, or some other resin material, which facilitates the excellent formation of a highly precise structure. Also, for bonding between the heater board, the ceiling plate, the orifice plate, and others, silicon or epoxy sealant or bonding agent is usually used in order to prevent recording liquid from leaking out into the liquid discharge head when the recording liquid is supplied.

The material, such as polysulfone or epoxy, used for the ceiling plate and orifice plate as described above, has a comparatively low surface energy, and in the liquid discharge head, difference may occur in the surface energy between the heater board and the ceiling plate or the orifice plate. Also, the plural members that form the liquid discharge head as described above are usually bonded by use of sealant or bonding agent. Then, the sealant or bonding agent thus applied allows its water-repellent property to affect recording liquid in the area surrounding such bonding portions. As a result, even if the heater board has hydrophilic property itself, it tends to present hydrophobic tendency eventually on the area surrounding the portion where the heater board is bonded.

Then, particularly when the head is used for a long time, or in the similar condition, there is a fear that air accumulation is caused to take place near the ceiling plate or orifice plate where the surface energy is comparatively low, such as the bonded portion having sealant applied thereto in particular, as indicated at 105 in FIG. 16, for example: there occurs an air accumulation centering the portion surrounding the bonding portion between the heater board 101 and the ceiling plate 102 where sealant 103 is applied. If such air accumulation as indicated at 105 occurs, the discharge performance of recording liquid is caused to change or the colorant contained in recording liquid is caused to be condensed, because the recording liquid is in contact with air, among some other unfavorable influences that may be exerted.

Here, a method for suppressing the occurrence of such air accumulation is disclosed in the specification of Japanese Patent Laid-Open Application 11-42798, in which before ink is initially filled in a head, the liquid that has a high wettability is filled in the head so as to remove any hydrophobic film formed on the inner face of the head, and also, to cover the inner face with such liquid in order to fill ink in good condition. With this method, however, it is impossible to maintain such cover for a long time. After a certain period elapses, the sealant portion that has water-repellent property, or the like, is exposed on the inner face of the head, and then, there is a fear that air accumulation occurs eventually.

SUMMARY OF THE INVENTION

It is, therefore, an object of the present invention to solve the problems discussed above, and provide a highly reliable lipid discharge head capable of filling recording liquid inside in a good condition and maintaining such condition for a long time, and also, provide a surface modifying method for the inner face of the liquid discharge head, as well as a method for manufacturing such liquid discharge head.

In order to achieve this object, the liquid discharge head of the present invention, which records by discharge recording liquid, is characterized by having:

a first portion with lyophilic group for lyophilic processing on a partial surface formed at least on a part of the inner face having recording liquid internally filled to be in contact therewith, and a second portion with a group having substantially the same or the same interfacial energy as the surface energy of the partial surface but different from the interfacial energy of the lyophilic group, while the second portion being orientated toward the partial surface, and the first portion being orientated in the direction different from the partial surface.

With the structure thus arranged, the surface energy of the inner face of the liquid discharge head is essentially uniformalized, hence preventing air accumulation from being generated in the portion having lower surface energy.

The present invention is particularly effective for a liquid discharge head for which the portion where recording liquid is filled is formed by bonding a plurality of members together. In other words, bonding agent or sealant is used usually for bonding them, and for that matter, there occurs the portion that presents hydrorepellency on the inner face of the liquid discharge head. In accordance with the present invention, however, such portion is processed to be lyophilic to suppress the air accumulation thereon. Also, with the formation of the surface processed to be lyophilic, it becomes possible to suppress the generation of eluted substance from bonding agent or sealant. Particularly, in accordance with the present invention, it is possible to perform the lyophilic processing on the portion where bonding agent or sealant is exposed on the inner surface even when the bonding agent or the sealant is formed by silicon or epoxy material.

Also, when at least parts of plural materials themselves are formed by those having the surface different from each other, it becomes possible to make the surface energy of the inner face, which is formed by the materials having different surface energy from each other, essentially equal so as to suppress air accumulation on the portion having lower surface energy.

For the liquid discharge head formed by bonding a plurality of members as described above, there is a liquid discharge head comprising a base plate having discharge energy generating members for generating energy for discharging the recording liquid; a ceiling plate bonded to the base plate with grooves formed on the bonded face to constitute liquid flow paths communicated with discharge ports for discharging the recording liquid, being passed through above the discharge energy generating members; and an orifice plate having the discharge ports opened, and bonded to the base plate and the ceiling plate to enable the discharge ports to be communicated with the liquid flow paths. The liquid discharge head of the present invention is preferably applicable to a liquid discharge head of the kind.

Also, the present invention is preferably applicable to a liquid discharge head provided with a ceiling plate having integrally formed with the aforesaid orifice plate, that is, the liquid discharge head comprising discharge a base plate having discharge energy generating members for generating energy for discharging the recording liquid; and a ceiling plate bonded to the base plate with grooves formed on the bonded face to constitute liquid flow paths communicated with discharge ports for discharging the recording liquid, being passed through above the discharge energy generating members, the discharge ports communicated with the liquid flow paths being opened on the ceiling plate.

The aforesaid ceiling plate or orifice plate is formed by resin material containing polysulfone or epoxy. The resin material of the kind has comparatively low surface energy. The present invention is preferably applicable to the liquid discharge head having the ceiling plate or the orifice plate formed by a material of the kind. In other words, with the surface energy of the inner face formed by such ceiling plate or orifice plate being made essentially equal to that of the base plate, it becomes possible to suppress the air accumulation which is generated on the inner surface formed by the ceiling plate or orifice plate.

The surface modifying method of the present invention for the inner face of a liquid discharge head is the one for performing lyophilic processing on a partial surface by providing a functional group for lyophilic processing on the partial surface of a liquid discharge head for recording by discharging recording liquid constituting at least a part of the inner face having the recording liquid internally filled to be in contact therewith, which comprises the following steps of:

firstly, providing the partial surface with liquid containing subdivided products having a first portion and a second portion obtainable by cleaving polymer for giving functional group having the first portion provided with the functional group, and the second portion having a group of substantially the same or the same interfacial energy as the surface energy of the partial surface but different from the interfacial energy of the functional group;

secondly, orientating the second portion of the subdivided products to the partial surface side on the partial surface, and the first portion to the side different from the partial surface; and thirdly, condensing at least parts of subdivided products themselves orientated on the partial surface to effectuate the polymerization thereof.

Also, the surface modifying method for performing lyophilic processing on a partial surface by providing a functional group for lyophilic processing on the partial surface of a liquid discharge head for recording by discharging recording liquid constituting at least a part of the inner face having the recording liquid internally filled to be in contact therewith, comprising the following steps of:

firstly, providing the partial surface with liquid having dissolved therein dilute acid, volatile improver for giving affinity to the partial surface, and processing agent having polymer provided with a first portion having a group of substantially the same or the same interfacial energy as the surface energy of the partial surface, and a second portion having a group of different interfacial energy from the interfacial energy;

secondly, removing the infinity improver by giving heat to the partial surface;

thirdly, concentrating the dilute acid to cleave polymer in the processing agent; and fourthly, condensing the cleaved polymer on the partial surface, while orientating the first portion of the polymer toward the partial surface, and the second portion to the different from the partial surface.

Also, the surface modifying method for performing hydrophilic processing on a partial surface having hydrophobic property to form at least a part of the inner face of a liquid discharge head for recording by discharging recording liquid having the recording liquid internally filled to be in contact therewith, comprising the step of cleaving polymeric compound having a hydrophilic group and a hydrophobic group to generating subdivided products, and orientate the hydrophilic group toward the partial surface side, and the hydrophobic group in the direction different from the hydrophobic group for the adhesion thereof to the partial surface.

Also, the surface modifying method for performing lyophilic processing on a partial surface by providing a functional group for lyophilic processing on the partial surface of a liquid discharge head for recording by discharging recording liquid constituting at least a part of the inner face having the recording liquid internally filled to be in contact therewith, comprising the steps of firstly, providing the partial surface with liquid containing polymer different from the formation material of the partial surface having a first portion with the functional group, and a second portion having a group of substantially the same or the same interfacial energy as the surface energy of the partial surface, but different from the interfacial energy of the functional group; and secondly, orientating the second portion toward the partial surface, and the first portion to the side different from the partial surface.

Further, this method comprises a third step of providing catalyst for use of polymeric cleavage in the liquid containing polymer in the first step; and a forth step of cleaving the polymer on the partial surface utilizing the catalyst for use of polymeric cleavage to make subdivided productd polymer.

Further, this method comprise a step of binding the subdivided productd polymer on the partial surface.

In accordance with the surface modifying method of the present invention, it becomes possible to provide the orifice surface with water-repellent property with ease by allowing the water-repellent film to be exposed by cutting off the hydrophilic film by the laser irradiation or blade cleaning without causing any chemical changes on the water-repellent film even if processing liquid adheres to the orifice plate surface where the water-repellent film is formed so that the hydrophilic film is formed on the water-repellent film when the processing liquid is provided for the inner face for the execution of surface modification.

The liquid discharge head of the present invention is the one for recording by discharging recording liquid provided with a hydrophobic surface on a partial surface forming at least a part of inner face having the recording liquid internally filled to be in contact therewith, the hydrophobic surface being modified to be hydrophilic surface, in which subdivided products having a hydrophilic group and a hydrophobic group are generated by cleaving polymeric compound having the hydrophilic group and the hydrophobic group, and the hydrophobic group is orientated toward the hydrophobic surface side, and the hydrophilic group is orientated in the direction different from the hydrophobic group to adhere to the hydrophobic surface.

BRIEF DESCRIPTION OF THE DRAWINGS

FIG. 6A shows the case where a first group that serves as a functional group, and a second group used for adhesion to the surface of the element are both in the side chain of polymer;

FIG. 6B shows the case where the second group is contained in the main chain.

DESCRIPTION OF THE PREFERRED EMBODIMENTS

Next, with reference to the accompanying drawings, the embodiments will be described in accordance with the present invention. Here, for the present invention, property superior to the wettability of liquid to be received is called the "lyophilic" property, and in the embodiments given below, the description will be made of liquid ink as the example of ink, and also, of the case where the hydrophilic property of the "lyophilic" property is provided in particular. Here, for the present invention, however, the kind of ink is not necessarily limited to the liquid ink. The invention is also applicable to the use of an oil-based ink. In such case, the property provided for the surface is "lipophilic".

(First Embodiment)

Figure 1A:
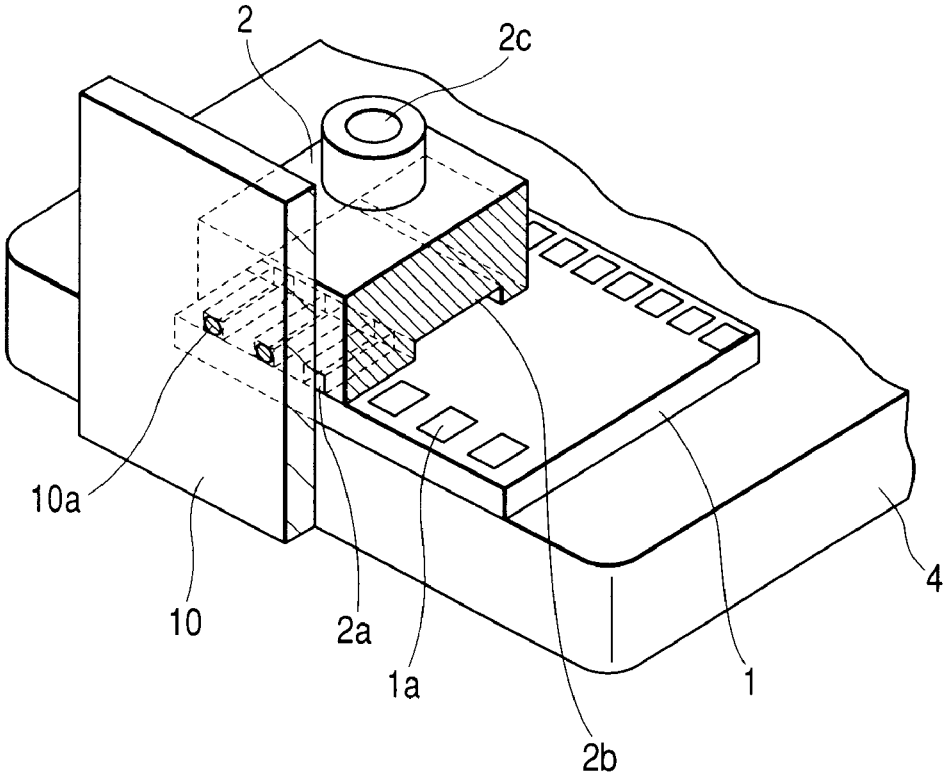
FIG. 1A is a perspective view which schematically shows a liquid discharge head in accordance with a first embodiment of the present invention.
Figure 1B:
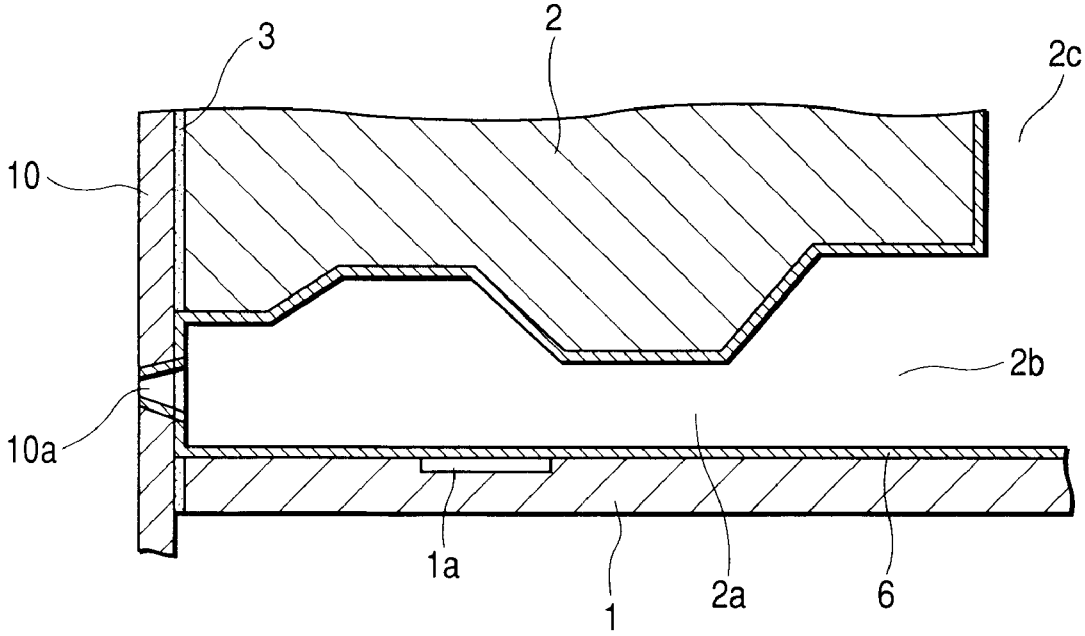
FIG. 1B is a cross-sectional view which shows the liquid discharge head represented in FIG. 1A.

FIGS. 1A and 1B are views which schematically illustrate a liquid discharge head in accordance with a first embodiment. FIG. 1A is a partially broken perspective view showing this liquid discharge head. FIG. 1B is a cross-sectional view taken along the liquid flow path thereof.

The liquid discharge head comprises a heater board (base plate) 1 having a plurality of heaters (electrothermal converting members) 1*a* fixed to a supporting member 4; a ceiling plate 2 bonded thereon; and an orifice plate 10 having a plurality of openings provided for the discharge ports 10*a* corresponding to the heaters 1*a*. For the ceiling plate 2, a liquid supply port 2*c* is formed for liquid to be supplied from outside. Then, on the face of the ceiling plate 2 bonded with the heater board 1, a groove is formed in a designated pattern. By the groove thus patterned, a common liquid chamber 2*b* communicated with the liquid supply port 2*c*, and the liquid flow path, which is communicated with the discharge port 10*a* through above each of heater 1*a*, is formed.

For the ceiling plate 2 and the orifice plate 10 of the liquid discharge head, resin material, such as polysulfone, epoxy, is preferably used. Also, for bonding between the heater board 1, the ceiling plate 2, and the orifice plate 10, sealant or bonding agent, such silicon, epoxy, is used so as not to allow liquid from leaking when ink is supplied into the liquid discharge head.

The recording operation of the liquid discharge head is performed by discharging ink selectively from discharge port 11*a* by bubbling liquid in the corresponding liquid flow path 2*a* with the heater 1*a* which generates heat when electric power is selectively supplied thereto in a state of ink being filled in the common liquid chamber 2*b* and the liquid flow path 2*a* through the liquid supply port 2*c*.

The liquid discharge head of the present embodiment is characterized in that the surface 6, which is processed to be hydrophilic, is formed on the inner face thereof As the surface modifying method for forming such surface 6 processed to be hydrophilic, the inventors hereof have proposed a technique in Japanese Patent Laid-Open Application 11-345628. The surface modifying method thus proposed is preferably usable when a hydrophilic processing is given to the inner face of the liquid discharge head provided with a comparatively complicated structure formed by the liquid flow path 2*a* and the common liquid chamber 2*b*, among some others, as well as the ceiling plate 2 and orifice plate 10 formed by polysulfone, epoxy, or some other resin material which are arranged to face such inner face of the head. For the present invention, this method is adopted for forming the surface processed to be hydrophilic. The principle and method will be described later specifically.

With this method of making a surface hydrophilic, the hydrophilic group 7 is provided on the inner face of a liquid discharge head, and is orientated to make the inner face uniformly and continuously hydrophilic. In other words, the surface energy of the inner face of the liquid discharge head is made uniform, which may become uneven without this processing.

Figure 2:
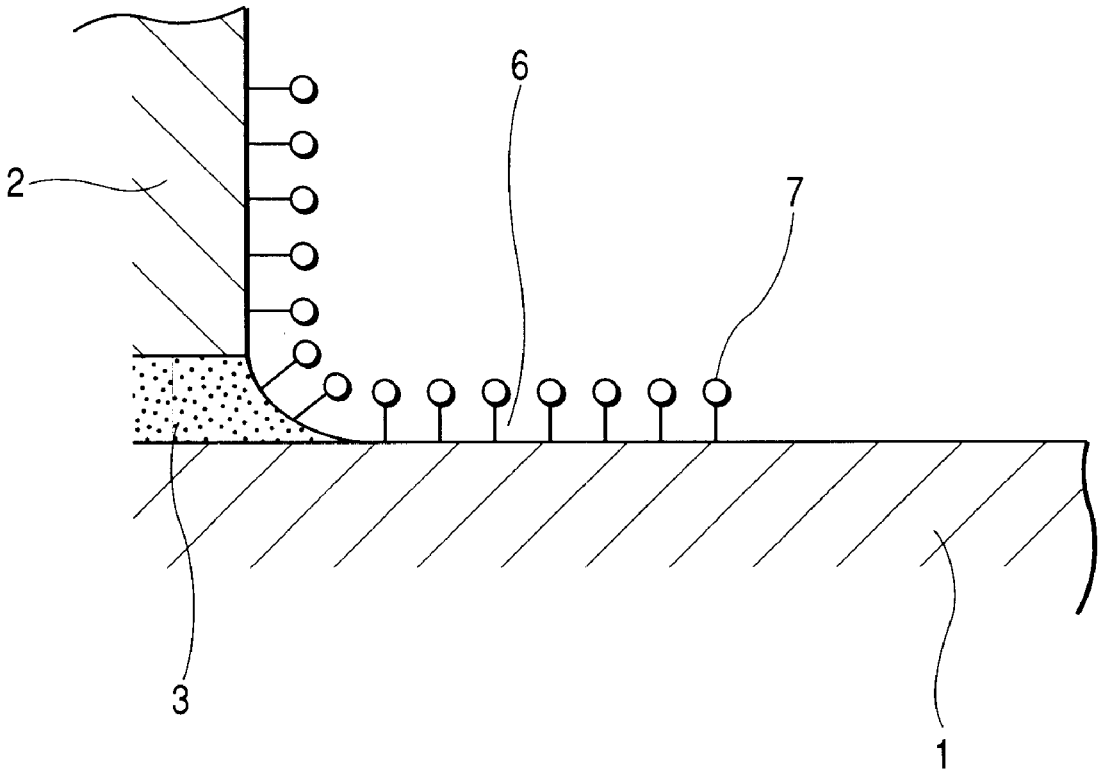
FIG. 2 is a cross-sectional view which shows schematically the vicinity of the bonded portion between the ceiling plate and the heater board of the liquid discharge head represented in FIGS. 1A and 1B.

Here, the range where the hydrophilic processing is given by the aforesaid method may be either the entire portion, with which liquid is in contact in the head as shown in FIG. 1B, that is, the inner faces of the orifice plate, the ceiling plate, the heater board, and the portions where sealant or bonding agent is applied as the bonding portions thereof or depending on the hydrophilic property of the heater board, such range may be the ceiling plate, all the portions bonded by sealant or the like and only the portion in the vicinity of the bonding portion of the surface of the heater board where sealant or the like is allowed to run around as shown in FIG. 2 which is an enlarged schematic view of the portion concerned.

In either case, as shown schematically in FIG. 2, it is possible to provide the hydrophilic group 7 in such a manner to orientate it to the inner face side even on the portion where a water-repellent sealant 3 is provided so that even this portion can be provided with the hydrophilic property equally as the other portions. In this way, therefore, it becomes possible to suppress the generation of air accumulation, which is described in conjunction with the prior art, by avoiding the unevenness of surface energy on the inner face of the liquid discharge head, particularly by removing water-repellent property on the respective bonding portions between the ceiling plate 2, the heater board 1 and orifice plate 10, and on the circumference of such bonding portions. In this respect, the description has been made of the example schematically shown in FIG. 2 where sealant exists on the boundary face of two members, but it is of course possible to apply the present invention effectively to the portion where two members are bonded by use of bonding agent.

Also, the surface 6, processed by this hydrophilic processing method to be hydrophilic, is excellent in its stable and durable property. Even when the liquid discharge head is used for a long time, the hydrophilic property of the inner face thus processed is equally maintained. Also, the surface 6 processed to be hydrophilic can produce the effects of preventing any unfavorable substance from being generated and eluted from sealant 3 to the ink, that may occur. Moreover, with this hydrophilic processing method such a hydrophilic-processed surface can be formed by thin film polymer of molecular level, and the hydrophilic processing can be accomplished, essentially, without changing the inner structure and size of a liquid discharge head. In this respect, the selection of whether the hydrophilic processed surface is provided for the entire body of the heater board or provided only for the circumference of the bonded portion is dependent of the hydrophilic property of the heater board as described earlier. However, if there is any fear that the hydrophilic-processed surface 6, which is formed by the hydrophilic processing method, is confronted with the breakage of the covering film of heaters on the heater board by the repeated heat generation of the heater, it is desirable to make the formation of such surface only for the circumference of the bonded portion.

As described above, in accordance with the present embodiment, it becomes possible to fill liquid inside a liquid discharge head in good condition, and maintain such condition for a long time, thus providing a highly reliably liquid discharge head.

(Second Embodiment)

Figure 3A:
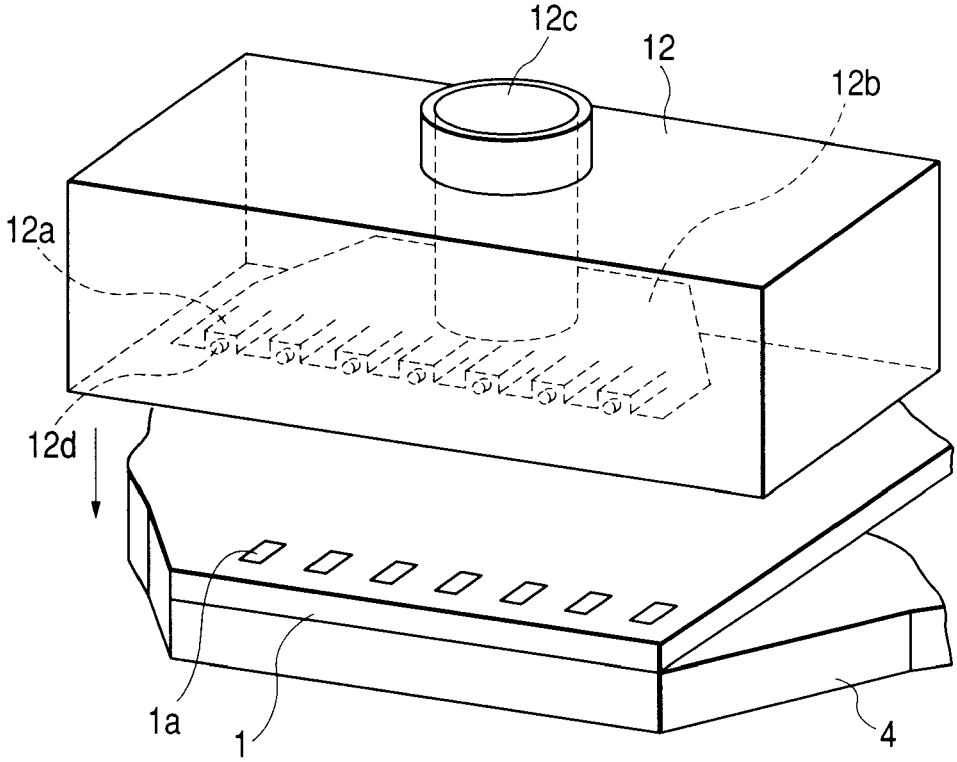
FIG. 3A is a perspective view which schematically shows a liquid discharge head in accordance with a second embodiment of the present invention.
Figure 3B:
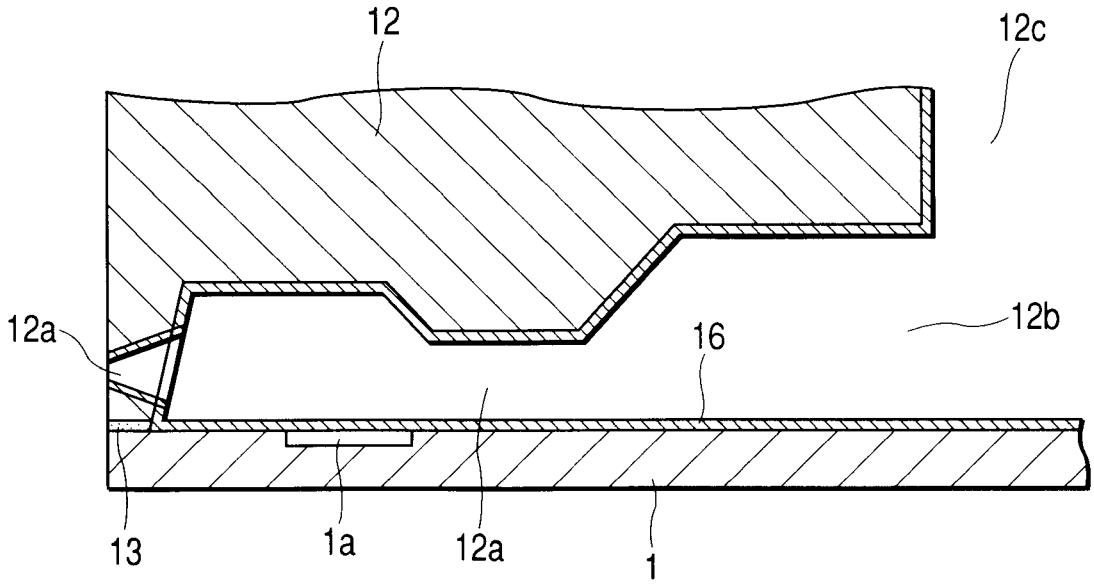
FIG. 3B is a cross-sectional view which shows the liquid discharge head represented in FIG. 3A.

FIGS. 3A and 3B are views which schematically illustrate a liquid discharge head in accordance with a second embodiment of the present invention. FIG. 3A is an exploded perspective view of the liquid discharge head. FIG. 3B is a cross-sectional view taken along the liquid flow paths. In FIGS. 3A and 3B, the same reference marks are provided for the same parts as those described in the first embodiment, and the description thereof will be omitted.

The liquid discharge head of the present embodiment is provided with the ceiling plate 12 having formed thereon the liquid supply port 12*c* to which ink is supplied from outside; the common liquid chamber 12*b* which is communicated with the liquid supply port; the liquid flow path 12*a* which conducts ink through above each heater la; and the discharge port 12*d* which is communicated with the liquid flow path to discharge ink. As the material of the ceiling plate 12, it is preferable to use polysulfone, epoxy, or some other resin material. Also, for bonding between the ceiling plate 12 and the heater board 1, sealant 13 is used to prevent ink leakage from occurring in the bonded portion.

The inner face of the liquid discharge port of the present embodiment is given the same hydrophilic processing as the first embodiment, and the hydrophilic-processed surface 16 is formed thereon as schematically shown in FIG. 3B. In this way, it becomes possible to essentially uniformalize the surface energy of the inner face of the liquid discharge head, which should be made different between the ceiling plate 12 and the heater board 1 if no hydrophilic processing is given. Further, in a case where no hydrophilic processing is given, the sealant portion 13 that presents water-repellent property, and the circumference thereof can be made hydrophilic, thus making it possible to suppress the elution that may be generated from the sealant 13 as the case may be.

As described above, in accordance with the present embodiment, it becomes possible to fill liquid inside a liquid discharge head in good condition, and maintain such condition for a long time, thus providing a highly reliably liquid discharge head.

(Third Embodiment)

Figure 4A:
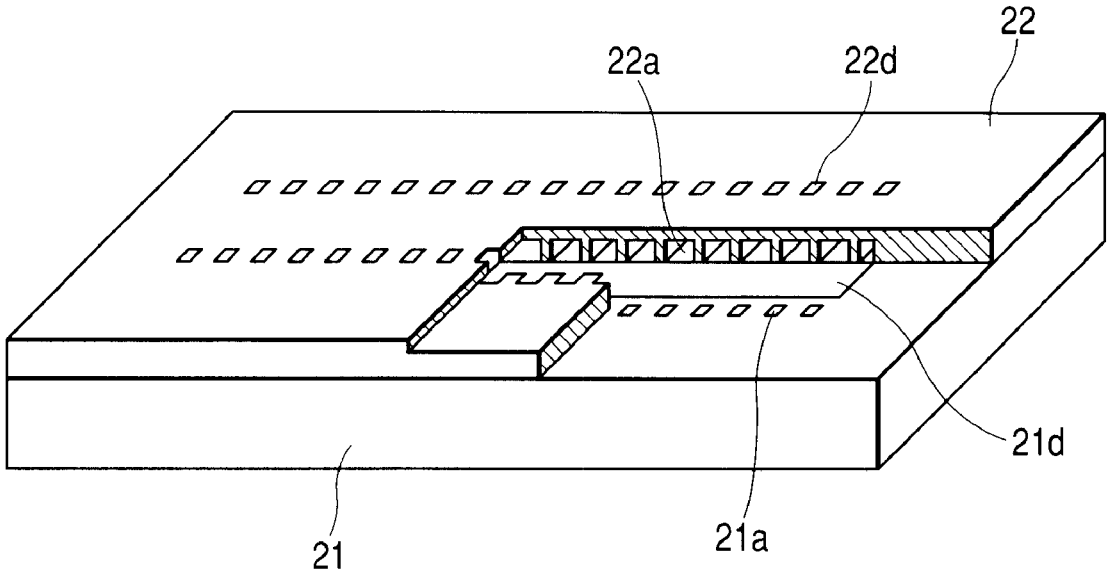
FIG. 4A is a perspective view which schematically shows a liquid discharge head in accordance with a third embodiment of the present invention.
Figure 4B:
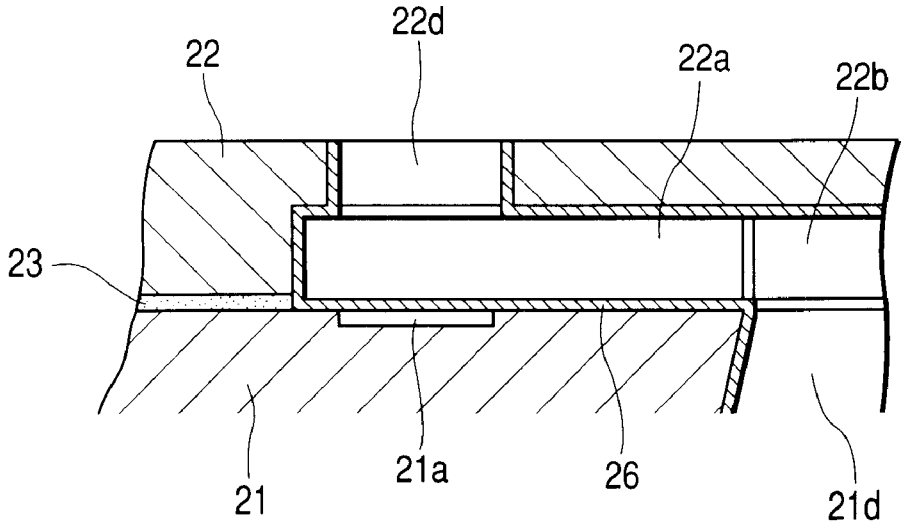
FIG. 4B is a cross-sectional view which shows the liquid discharge head represented in FIG. 4A.

FIGS. 4A and 4B are views which schematically illustrate a liquid discharge head in accordance with a third embodiment of the present invention. FIG. 4A is a partially broken perspective view which shows the liquid discharge head. FIG. 4B is a cross-sectional view taken along the liquid flow path thereof.

The liquid discharge head is provided with a heater board 21 having heaters 21*a* formed in two lines thereon. For the heater board 21, the liquid supply port 21*b*, to which liquid is supplied from outside, is open between the two lines of heaters 21*a*. On the heater board 21, there is bonded a ceiling plate 22 having each of discharge ports 22*d* formed to be open immediately above each of the heaters 21*a* for discharging ink. On the bonded face of the ceiling plate 22 with the heater board 21, there is formed the groove which structures a common liquid chamber 22*b* positioned immediately above the liquid supply port 21*b*, and the liquid flow path 22*a* which is communicated with the discharge port 22*d* therefrom through above the heater 21*a*.

For the liquid discharge head of the present embodiment, polysulfone, epoxy, or some other resin material is preferably used as the material of the ceiling plate 22. Also, for the bonding of the ceiling plate 22 and the heater board 21, sealant 23 is used so not to allow ink to leak from the bonded portion.

The inner face of the liquid discharge head of the present embodiment is given the hydrophilic processing as in the first embodiment to form the hydrophilic-processed surface 26 as shown in FIG. 4B. In this way, it becomes possible to essentially uniformalize the surface energy of the inner face of the liquid discharge head, which should be made different between the ceiling plate 22 and the heater board 21 if no hydrophilic processing is given. Further, in a case where no hydrophilic processing is given, the sealant portion 23 that presents water-repellent property, and the circumference thereof can be made hydrophilic, thus making it possible to suppress the elution that may be generated from the sealant 23 as the case may be.

As described above, in accordance with the present embodiment, it becomes possible to fill liquid inside a liquid discharge head in good condition, and maintain such condition for a long time, thus providing a highly reliably liquid discharge head.

(Liquid Discharge Recording Apparatus)

Figure 5:
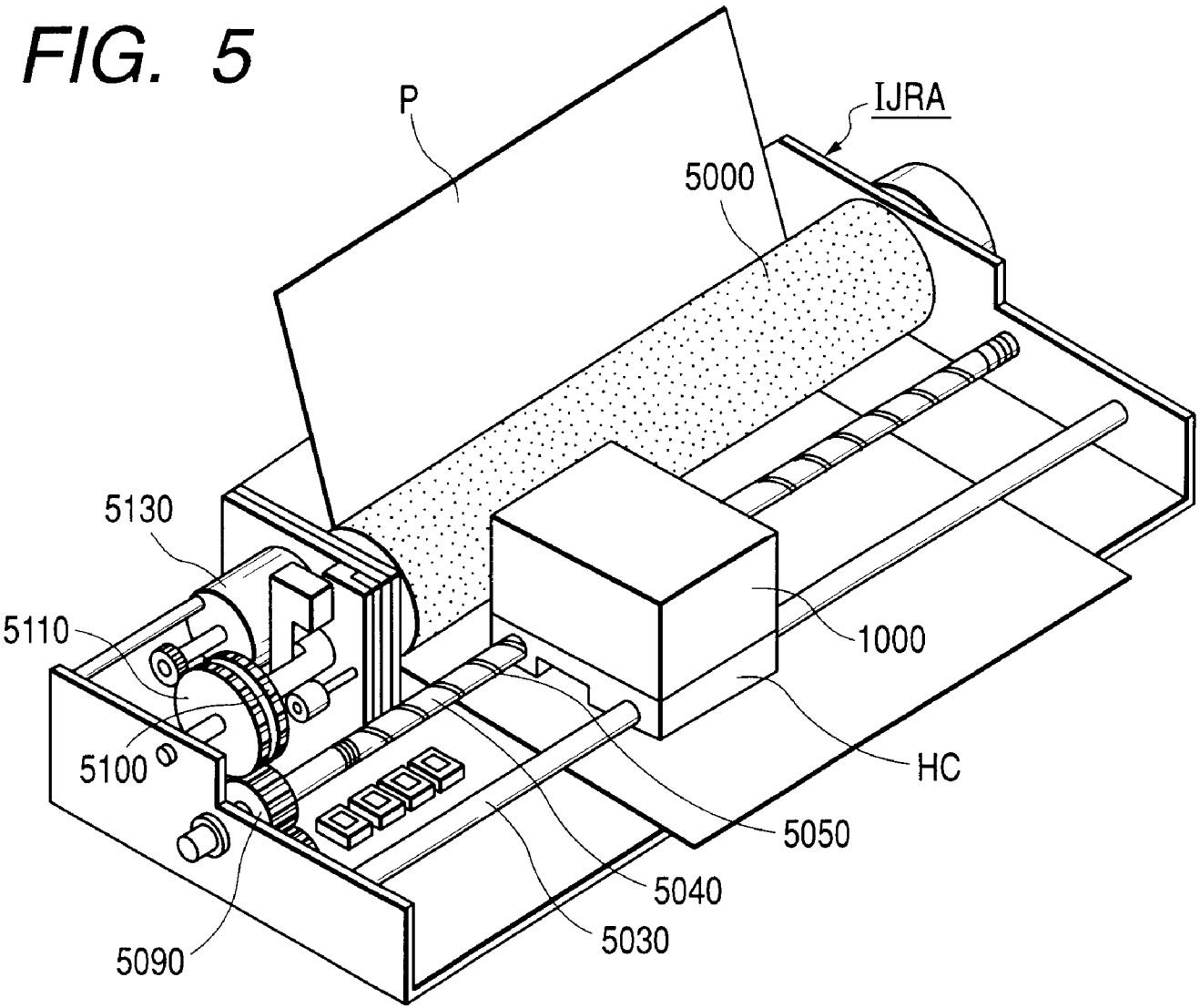
FIG. 5 is a perspective view which schematically shows one example of a liquid discharge recording apparatus capable of mounting a liquid discharge head of the present invention.

Next, with reference to FIG. 5, the description will be made of the one example of the liquid discharge recording apparatus that records with the liquid discharge head of each of the embodiments described above, which is mounted thereon. FIG. 5 is a perspective view which schematically shows the liquid discharge recording apparatus IJRA.

In FIG. 5, the liquid discharge head may be installed on a carriage HC in advance or fixedly supported by positioning means (not shown) of the carriage HC together with a liquid container 1000.

The regular and reverse rotations of a driving motor 5130 is transmitted to a lead screw 5040 through driving power transmission gears 5110, 5100, and 5090 to rotate the lead screw. Also, the carriage HC, which engages with the spiral groove 5050 of the lead screw 5040, can reciprocate along a guide shaft 5030. Also, a conveying roller 5000 is rotatively driven to convey a recording sheet P below the reciprocation passage of the carriage HC.

Recording by the liquid discharge recording apparatus IJRA is performed in such a way that the recording sheet P is guided by the conveying roller 5000 to the recording position below the reciprocation passage of the carriage HC, and that while the carriage HC travels, ink is discharged from the liquid discharge head mounted on the carriage to enable ink to adhere to the recording sheet P.

Of the ink jet recording methods, the present invention demonstrates excellent effects on the one that utilizes thermal energy to form flying droplets in particular.

For the typical structure and operational principle of such method, it is preferable to adopt those implemental by the application of the fundamental principle disclosed in the specifications of U.S. Pat. Nos. 4,723,129 and 4,740,796, for example. This method is applicable to the so-called on-demand type recording and a continuous type recording as well. Here, in particular, with the application of at least one driving signal that corresponds to recording information, the on-demand type provides an abrupt temperature rise beyond nuclear boiling by each of the electrothermal converting members arranged corresponding to a sheet or a liquid path where liquid (ink) is retained. Then, thermal energy is generated by the electrothermal converting member, hence creating film boiling on the thermal activation surface of recording head to effectively form resultant bubble in liquid (ink) one to one corresponding to each driving signal. Then, by the growth and shrinkage of bubble, liquid (ink) is discharged through each of the discharge openings, hence forming at least one droplet. The driving signal is more preferably in the form of pulses because the growth and shrinkage of bubble can be made instantaneously and appropriately so as to attain the performance of excellent discharge of liquid (ink), in particular, in terms of the response action thereof.

The driving signal given in the form of pulses is preferably such as disclosed in the specifications of U.S. Pat. Nos. 4,463,359 and 4,345,262. In this respect, the temperature increasing rate of the thermoactive surface is preferably such as disclosed in the specification of U.S. Pat. No. 4,313,124 for the excellent recording in a better condition.

As the structure of the recording head, there are included in the present invention, the structure such as disclosed in the specifications of U.S. Pat. Nos. 4,558,333 and 4,459,600 in which the thermal activation portions are arranged in a curved area, besides those which are shown in each of the above-mentioned specifications wherein the structure is arranged to combine the discharging openings, liquid paths, and the electrothermal transducing members (linear type liquid path or right-angled liquid path).

In addition, the present invention is effectively applicable to the structure disclosed in Japanese Laid-Open Application 59-123670 wherein a common slit is used as the discharging openings for plural electrothermal transducing devices, and to the structure disclosed in Japanese Patent Laid-Open Application 59-138461 wherein an aperture for absorbing pressure waves of thermal energy is formed corresponding to the discharge openings.

Further, the present invention can be utilized effectively for the full-line type recording head the length of which corresponds to the maximum width of a recording medium recordable by such recording apparatus. For the full-line type recording head, it may be possible to adopt either a structure whereby to satisfy the required length by combining a plurality of recording heads or a structure arranged by one integrally formed recording head.

In addition, the present invention is effectively applicable to the freely exchangeable chip type recording head, for which electrical contact with the apparatus main body and ink supply form the apparatus main body are made possible when installed on the apparatus main body or to the cartridge type recording head having ink tanks integrally formed with the recording head itself.

Also, for the present invention, it is preferable to additionally provide a recording head with recovery means and preliminarily auxiliary means as constituents of the recording apparatus, because these additional means contribute to making the effectiveness of the present invention more stabilized. To name them specifically, these are capping means, cleaning means, suction or compression means, pre-heating means such as electrothermal converting members or heating elements other than such converting members or the combination of those types thereof. Here, also, the performance of a pre-discharge mode whereby to make discharge other than the regular discharge is effective for the execution of stable recording.

Further, the present invention is extremely effective in applying it not only to a recording mode in which only main color such as black is used, but also to an apparatus having at least one of multi-color modes with ink of different colors, or a full-color mode using the mixture of colors, irrespective of whether the recording heads are integrally structured or it is structured by a combination of plural recording heads.

In the embodiments of the present invention described above, ink has been described as liquid. However, the ink thus referred to therein may be an ink material which is solidified below the room temperature but soften or liquefied at the room temperature. Here, also, since ink is generally controlled for the aforesaid ink jet method to be within the temperature not lower than 30° C. and not higher than 70° C. to stabilize its viscosity for the execution of stable discharges, the ink may be such as to be liquefied when the applicable recording signals are given.

In addition, it may be possible to use ink which is liquefied only by the application of thermal energy, but solidified when left intact in order to positively prevent the temperature from rising due to the thermal energy by use of such energy as the energy which should be consumed for changing states of ink from solid to liquid, or consumed for the prevention of ink from being evaporated. In either case, for the present invention, it may be possible to adopt the use of ink having a nature of being liquefied only by the application of thermal energy, such as ink capable of being discharged as ink liquid by enabling itself to be liquefied anyway when the thermal energy is given in accordance with recording signals or to adopt the use of the ink which will have already begun solidifying itself by the time it reaches a recording medium. For the present invention, the most effective method that uses the various kinds of ink mentioned above is the one which is capable of implementing the film boiling method as described above.

Moreover, as the mode of the recording apparatus in accordance with the present invention, it may be possible to adopt a copying apparatus combined with a reader, in addition to the image output terminal for a computer or other information processing apparatus, and also, it may be possible to adopt a mode of a facsimile equipment having transmitting and receiving functions.

In this respect, as the recording head, it may be possible to use the one that adopts a method utilizing piezoelectric element, besides the method described above.

(Surface Modifying Method)

Now, the description will be made further in detail of the aforesaid method for making the inner face of a liquid discharge head hydrophilic.

At first, the principle of the surface modifying of an element, which is applicable to the hydrophilic processing of the inner face of a liquid discharge head, will be described more specifically.

The surface modifying method to be described below can implement the intended surface modifying in such a way that, by using the functional group, or the like, possessing molecules contained in the substance that forms the surface of an element, the polymer (or polymeric subdivided products) is orientated specifically to enable it to adhere to the surface, thereby providing the surface with the associated property of the group to which the aforesaid polymer (or polymeric subdivided products) belongs.

Here, the term "element" means the element formed by various kinds of materials to provide a specific external form. Then, with this external form, the element has the outer surface externally exposed. In addition, the element may have an internal space, cavity, or hollow that contains a portion that can communicate externally to the element. Also, the inner surface (inner wall face) that encloses such portion can be arranged to be an element for the surface modifying processing. The hollow portion may include an inner surface and be completely insulated from the external portion. Such a completely insulated hollow can also be an element of this processing if it is possible to perform surface modifying processing on the surfaces of the hollow portion before the hollow portion is insulated from the outside.

As described above, the surface modifying method of the present invention is applicable to the surface, among all the surfaces of various kinds of elements, which allows a liquid type surface processing solution to be contact therewith from outside without spoiling the shape of the target element. Therefore, the outer surface of an element and the inner surface communicated therewith are assumed to be targets of the processing. Then, it is intended to change the property of the surface of a portion selective from the outer surface of the target element. Depending on the way of selection, the mode of selection of the outer surface of an element and the inner surface communicated therewith is included in the modification of the surface area of a desired portion. Here, ultimately, this surface modifying method is of course applicable to the inner surface that partitions the hollow portion of the hollow structure of an element if only a liquid type surface processing solution is allowed to be in contact with such surface from outside at least when the surface modifying method is executed, provided that such surface is yet to be the inner surface that partitions the target hollow portion.

With this surface modifying method, processing is given to the modifying portion (a partial surface) that structures at least a part of the surface possessed by an element. In other words, the target can be a part selected from the surface of an element or the entire surface thereof as desired.

As the shape of an element, there may be considered various ones, such as in the form of sheet, string, fabric, sphere, particle, tube, among some others. The fields of application are also various. However, this surface modifying method should be applied in accordance with each individual purpose. Usually, the target element is formed using various kinds of materials, such as plastic, resin, metal, glass, or those utilize natural material, such as paper, leather, artificial leather, among some others. This surface modifying method is applicable, in principle, to the surface of an element formed by any one of these kinds of materials.

Also, the phrase "the surface possessed by an element" referred to in the specification hereof includes both the surface that any one of the elements described above possesses itself, and the surface thereof which has been already processed in some way.

Also, the term "polymeric subdivided products" means either those partly dissociated from polymer or monomer. In the sense of embodiment, however, such part is assumed to include all the formation thereof when polymer is cleaved by acid. Also, the expression "polymeric filming" includes the formation of an essential film, and also, the film each part of which may present different orientation on the two-dimensional surface.

Hereinafter, in order to simplify the description of the principle of the surface modifying method, the example, in which the surface formed by a single substance is modified, is used for more specific description thereof.

(Principle of Surface Modification to be Conducted)

For the surface modification of an element applicable to the present invention, the polymer, which is formed by binding the main skeleton having a surface energy substantially equal to the surface (interfacial) energy of the surface of an element (surface of basis), and a group having surface energy different from the surface (interfacial) energy of the surface of an element, is utilized to enable the polymer to adhere to the surface of the element by use of the main skeleton portion having the surface energy substantially equal to the interfacial energy of the surface of the element in the surface modifying agent, and to enable the group having the surface energy different from the interfacial energy of the surface of the element to form a polymeric film (polymeric cover) orientated to the outer side with respect to the surface of the element for the attainment of this modification.

In other words, from the different point of view regarding the polymer used for the aforesaid surface modifying agent, it may be possible to grasp this polymer as the one which is provided with a second group the affinity of which is essentially different from that of the group exposed on the surface of an element before surface modification, and a first group which presents the affinity essentially similar to that of the group exposed on the surface of the element, which is contained in the repeating unit of the main skeleton thereof.

Figure 6A:
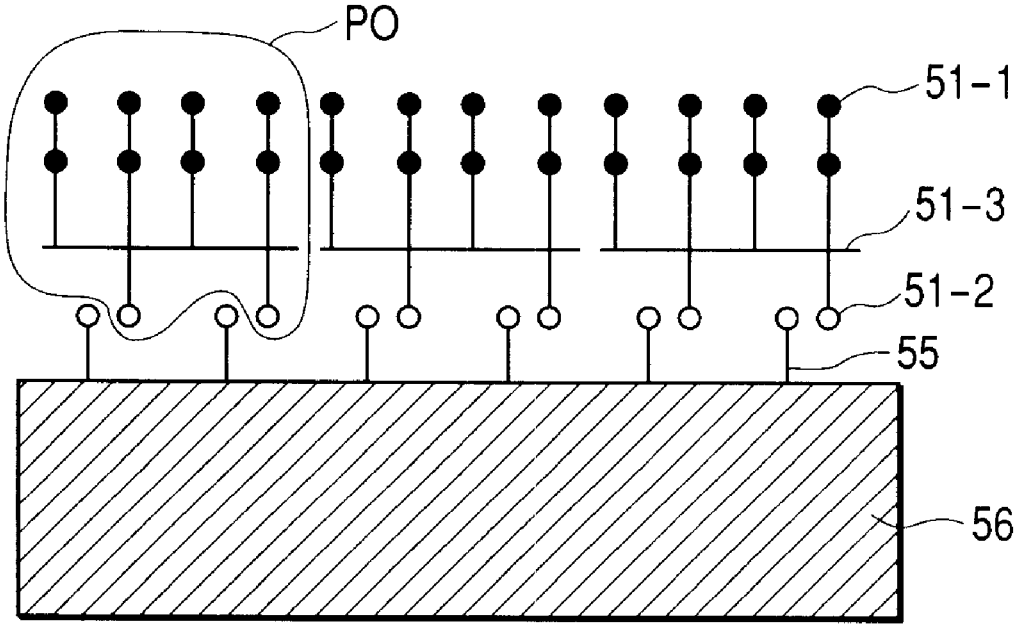
FIGS. 6A and 6B are views which schematically illustrate the adhesive mode of the polymer of a surface modifying agent, which is formed on the modifying surface of an element (basis), and the surface of the element as well in the surface modifying method applicable to the present invention.
Figure 6B:
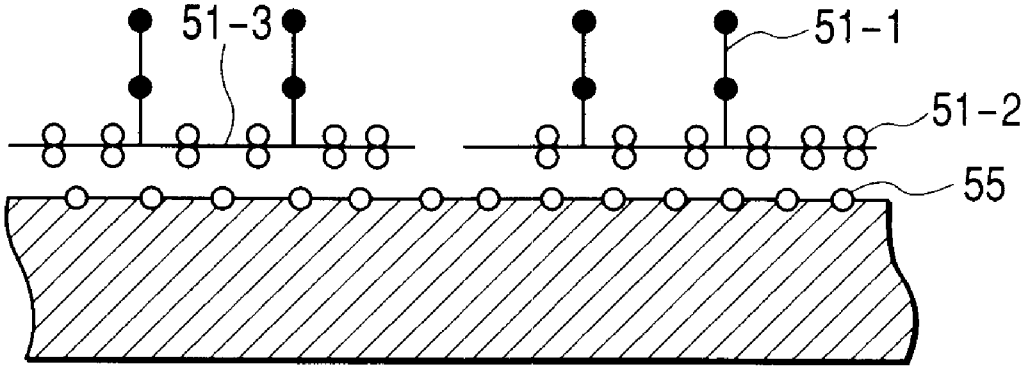

FIGS. 6A and 6B are views which schematically illustrate the typical example of such mode of orientation. FIG. 6A is a view which shows a case of using the polymer in which a first group 51-1 and a second group 51-2 are bound as the side chain with respect to the main chain 51-3. FIG. 6B is a view which shows a case where the second group 51-2 forms the main chain 51-3 itself, and the first group 51-1 forms the side chain.

Figure 15:
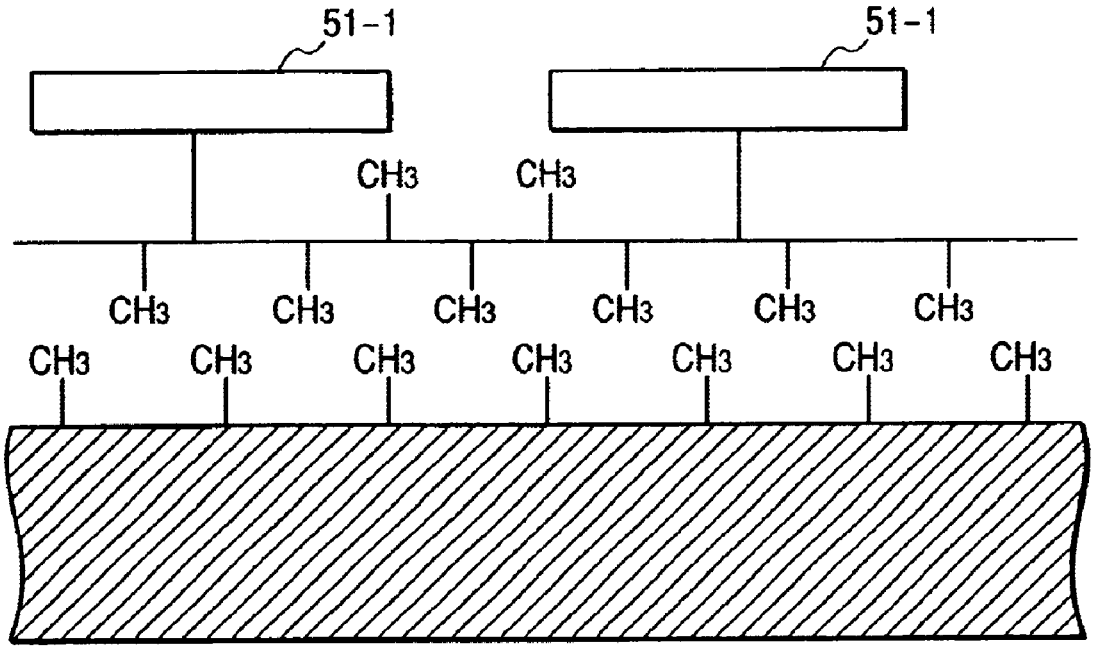
FIG. 15 is a view which schematically shows one example of the estimated distribution of the hydrophilic group and the hydrophobic group on the surface processed by surface modification in accordance with the present invention.
Figure 16:
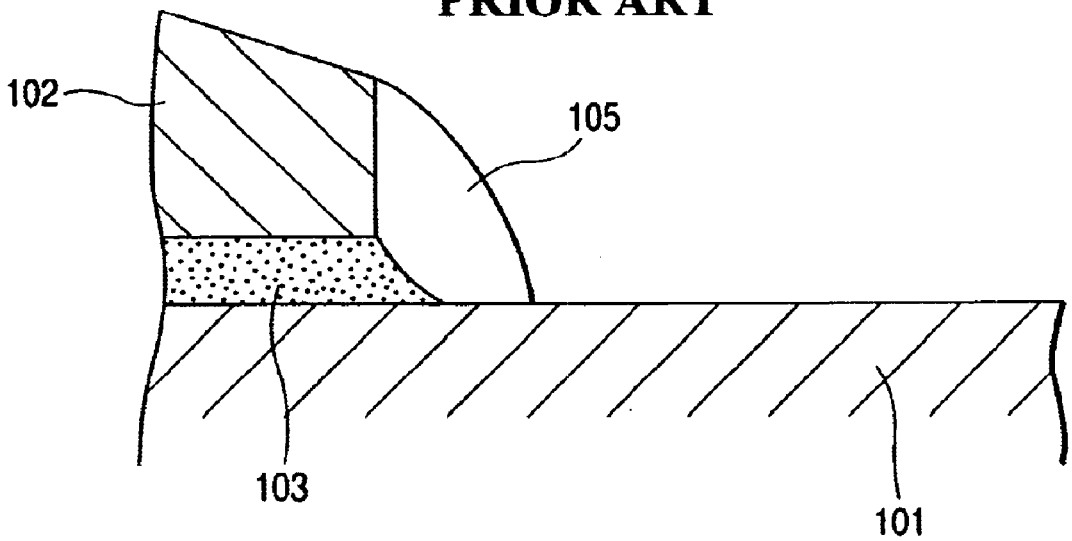
FIG. 16 PRIOR ART
FIG. 16 is a cross-sectional view which shows schematically the vicinity of the bonding portion of the ceiling plate and the heater board of the conventional liquid discharge head.

Taken the orientations shown in FIGS. 6A and 6B, the outermost surface (outer side) of the basis 56 that forms the surface of an element, which must be modified, presents the state where the group 51-1 having the surface energy different from the surface (interfacial) energy of the basis 56 is orientated on the surface. As a result, the surface is modified utilizing the accompanying property of the group 51-1 having the surface energy different from the surface (interfacial) energy of the basis 56. Here, the surface (interfacial) energy of the basis 56 is originated and determined by the group 55 on the surface of which the substance or molecule that forms the surface. In other words, the first group 51-1 acts as the functional group for use of the surface modification in the example shown in FIGS. 6A and 6B, and if the surface of the basis 56 is hydrophobic and the first group 51-1 is hydrophilic, a hydrophilic property is provided for the surface of the basis 56. In this respect, if the first group 51-1 is hydrophilic and the group 55 on the basis 56 side is hydrophobic, the state as shown in FIG. 15 is considered to be present when, for example, polysiloxane is utilized as described later. In this state, with the adjustment of balance between the hydrophilic group and hydrophobic group on the surface of the basis 56 after having been modified, it may be possible to adjust the passing condition or the flow rate at the time of passage, too, when water or aqueous liquid having water as its main component-passes on the surface of the basis 56 after modifying processing has been given. Conceivably, then, it becomes possible to effectively perform filling ink in an ink tank or supplying ink from the ink tank to a head in an excellent condition if such surface condition is established in the ink tank formed integrally with an ink jet recording head by fabric element of polyolefin, for example; which provides a fibrous outer wall face or such ink tank arranged as a separate component, while securing an appropriate negative pressure in the ink tank, hence securing the position of ink interface (meniscus) in good condition in the vicinity of discharge port of a recording head immediately after ink discharge.

Here, the description will be made of a specific method for using an improver for the enhancement of wettability of processing agent with respect to the good polymeric solvent and basis used for surface modification as the method for manufacturing an element having the modifiable surface as shown in FIGS. 6A and 6B. This method is such that the processing liquid (surface modification solution) that dissolves the polymer of surface modifying agent uniformly is coated on the surface of basis, and then, the polymer PO of surface modifying agent contained in this processing liquid is orientated as described above, while removing the solvent contained the processing liquid.

More specifically, a liquid (surface processing liquid) having a specific amount of surface modifying agent and acid mixed therein is prepared in a good solvent for the surface modifying agent, which can be coated on the surface of basis sufficiently, and after the surface processing liquid is applied to the surface of the basis, the solvent in the surface processing agent is removed by evaporation and drying in an solvent at a temperature of 60° C.

Here, for the present invention, to uniformly apply the polymer used for the surface modification, it is desirable to contain in solvent the organic solvent that presents a sufficient wettability on the surface of the basis and evenly dissolves the polymer serving as the surface modifying agent. Further, when the concentration of the polymer becomes higher during evaporation of the solvent, the polymer is dispersed uniformly in the coated liquid layer while maintaining a sufficiently dissolved condition. In addition to this effect, it becomes possible to evenly and uniformly cover a surface showing a complicated configuration, because the polymer (surface modifying agent) can be coated on the surface of the basis widely and uniformly with the sufficient wettability of the surface processing liquid with respect to the basis.

Also, it may be possible to contain further in the surface processing liquid a volatile solvent which does not present wettability to the surface of basis, and serves as a good solvent for the polymer of the surface modifying agent.

As the combination of such solvents, there is the combination of water and isopropyl alcohol when the modifying surface is formed by polyolefine resin.

Here, conceivably, the effect obtainable by adding acid in the surface modifying liquid is such that when the concentration of acid component is increased along with the evaporation of the used material, for example, a highly concentrated acid accompanied by a highly concentrated acid heating is expected to produce the effect that promotes the formation of a polymerized film (polymeric cover) through the polymerization of the polymer of surface modifying agent resulting from the partial decomposition (cleavage) and rebinding of polymer used for the surface modification.

Also, when the concentration of acid component is increased along with the evaporation of solvent in the evaporating and drying process of the surface modifying agent, it is anticipated to obtain the effect that a clean surface of basis, because this highly concentrated acid removes impurities on the surface of basis and in the vicinity thereof. With the clear surface thus obtained, it is also anticipated to enhance the physical force of adhesion of the basic substance or molecule, and the polymer of surface modifying agent, among some others.

Further, it is presumed that the surface of basis is decomposed due to a highly concentrated acid accompanied by heating, and active points appear on the surface of basis, and that a secondary chemical reaction may take place then to bind such active points and the subdivided products brought about by the aforesaid cleavage of polymer. As the case may be, it is conceivable that the enhanced stabilization of adhesion of the surface modifying agent exists locally on the basis owing to such secondary chemical adsorption between the surface modifying agent and basis.

Next, with reference to FIG. 7 to FIG. 13, the description will be made of the polymer filming process by the dissociation of a main skeleton having the surface energy substantially equal to the surface energy of the basis of a surface modifying agent (containing a hydrophilic processing agent), and the condensation of the subdivided products on the surface of basis in accordance with the example in which the functional group is a hydrophilic group, and hydrophilic property is given to the surface of a hydrophobic group. In this respect, the hydrophilic group is formed to be able to provide the hydrophilic property as a whole group. Here, the hydrophilic group itself or even the one which possesses hydrophobic chain or hydrophobic group, but has the function to be able to provide hydrophilic property as a group when substitutional arranged with hydrophilic group or the like, can be utilized as a hydrophilic group.

Figure 7:
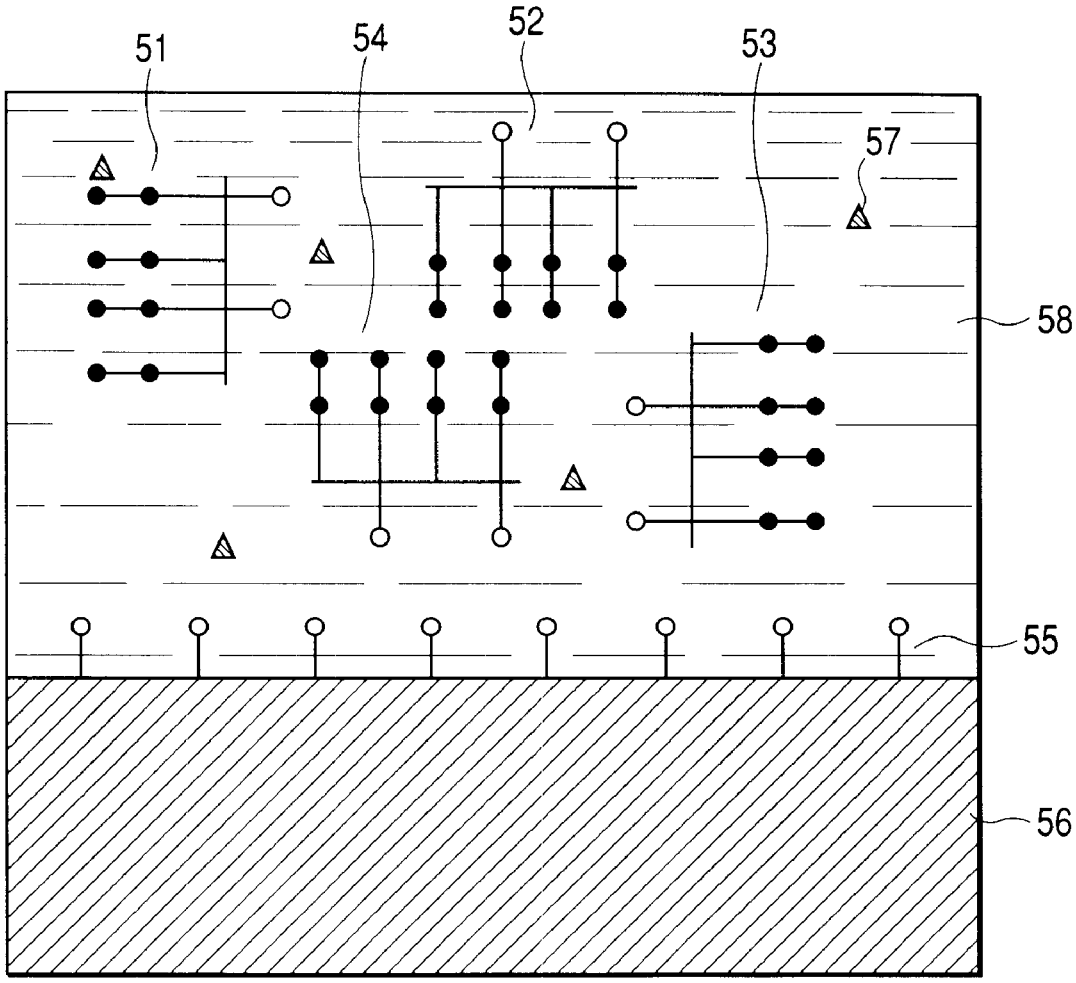
FIG. 7 is a view which schematically shows the state where the processing solution that contains polymer of the surface modifying agent is applied to form a coating layer on the base member in the surface modifying method applicable to the present invention.
Figure 8:
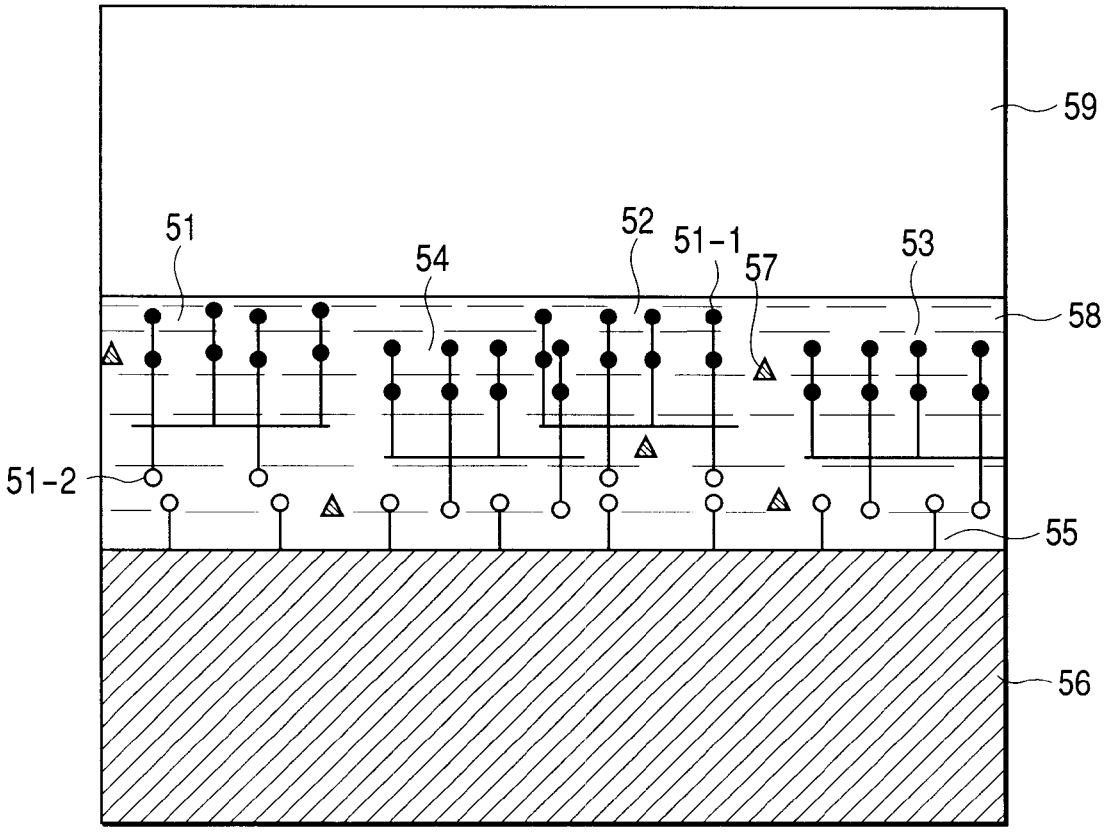
FIG. 8 is a conceptual view which shows a process to partly remove the solvent in the coating layer that contains polymer of the surface modifying agent formed on the base member in the surface modifying method applicable to the present invention.

FIG. 7 is an enlarged view which shows a state after a hydrophilic processing agent is coated. At this point, the polymer 51 to 54 and acid 57, which serve as hydrophilic processing agents contained in the hydrophilic processing liquid 58, are dissolved uniformly in the hydrophilic processing liquid on the surface of the basis 56. FIG. 8 is an enlarged view which shows a drying process subsequent to the coating of the hydrophilic processing agent. In drying accompanied by heating in the drying process subsequent to the coating of the hydrophilic processing agent, it is conceivable that the physical force of adsorption is enhanced for the basis 56 and the polymer 51 to 54 serving as the surface modifying agent by the clear surface of the basis 56 brought about by the rinsing action of the surface of the basis 56 when the impurity substance that exists on the surface of the basis 56 and in the vicinity thereof is removed as the concentration of acid component increases along with the evaporation of solvent. Also, in drying accompanied by heating in the drying process subsequent to the coating of the hydrophilic processing agent, there also exists conceivably the portion of the polymer 51 to 54 of the hydrophilic processing agent, the part of which is cleaved and decomposed, when the concentration of acid component increases along with the evaporation of solvent.

Figure 9:
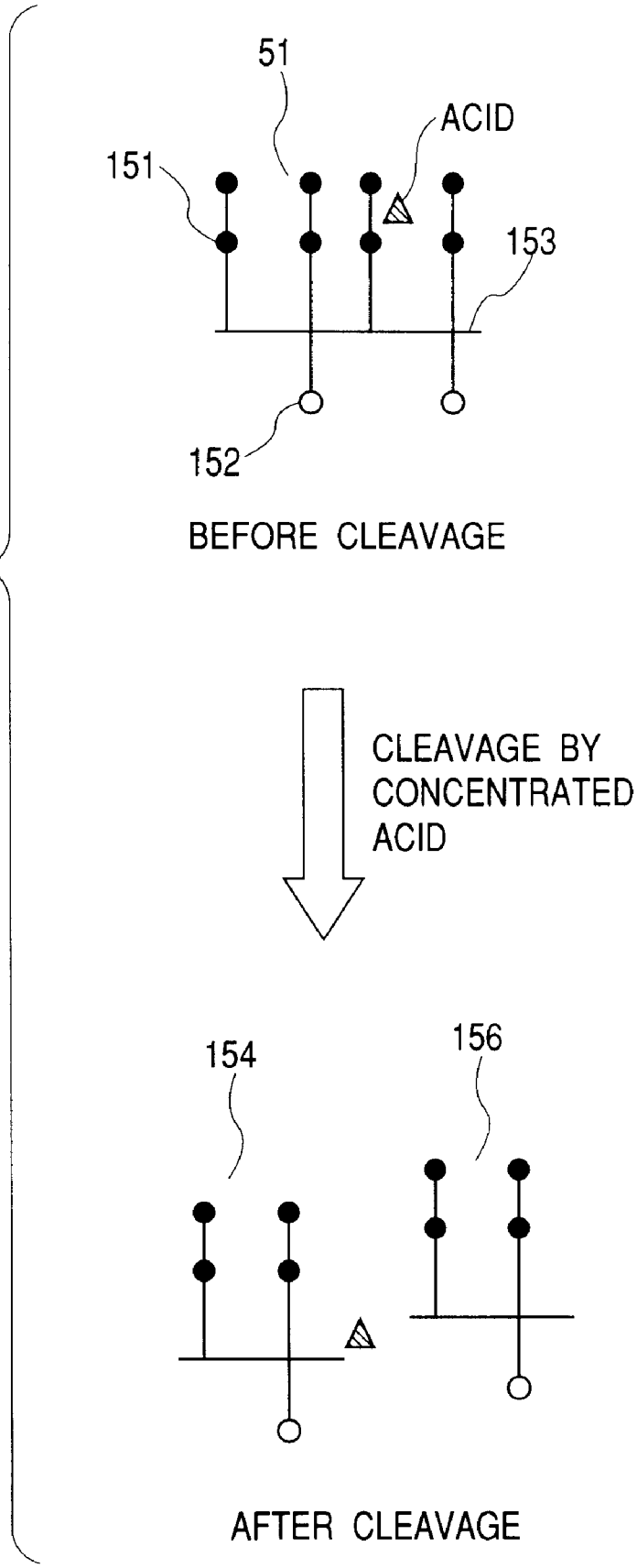
FIG. 9 is a conceptual view which shows a partial dissociation process of the polymer of the surface modifying agent induced by acid to be added to the processing solution, which is incidental to the partial removal process of the solvent in the coating layer that contains polymer of the surface modifying agent.
Figure 10:
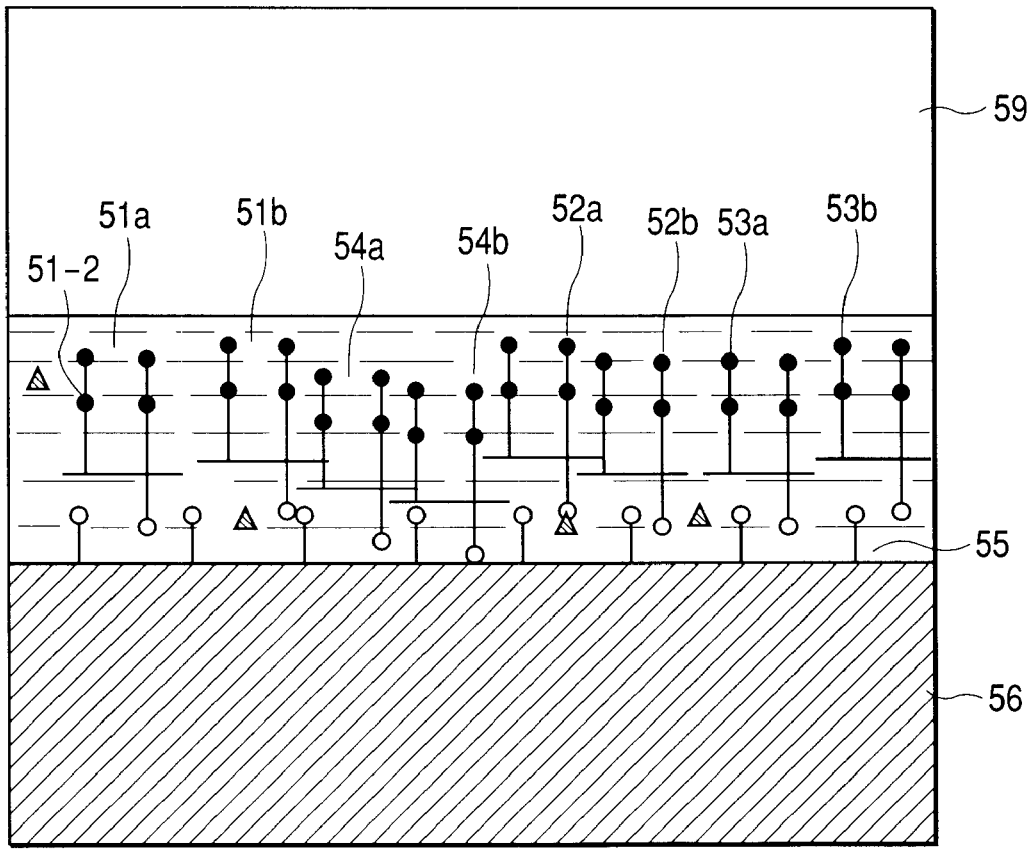
FIG. 10 is a conceptual view which shows an orientational formation process of the polymer of the surface modifying agent or of the dissociated subdivided products, which is incidental to the process in which the solvent in the coating layer that contains polymer of the surface modifying is further removed.

FIG. 9 is a view which schematically shows the decomposition of the polymer 51 by use of concentrated acid. FIG. 10 shows the state in which the hydrophilic processing agent thus decomposed is adsorbed to a basis. Further, with the advancement of solvent evaporation, the main skeleton portion of the subdivided products 51*a* to 54*b* of the polymer that forms the hydrophilic processing agent arrives at the saturation of dissolution and presents the surface energy substantially equal to the surface of energy of the basis. This portion is selectively adsorbed to the clear surface of the basis 56 which is formed by rinsing. As a result, the group 51-1 having the surface energy different from the surface energy of the basis 56 in the surface modifying agent is conceivably orientated to the outer side of the basis 56. In FIG. 9, a reference numeral 151 designates the first group; 152, the second group; 153, the main chain of the surface modifying again; 154, subdivided products 1; and 155, subdivided products 2.

Figure 11:
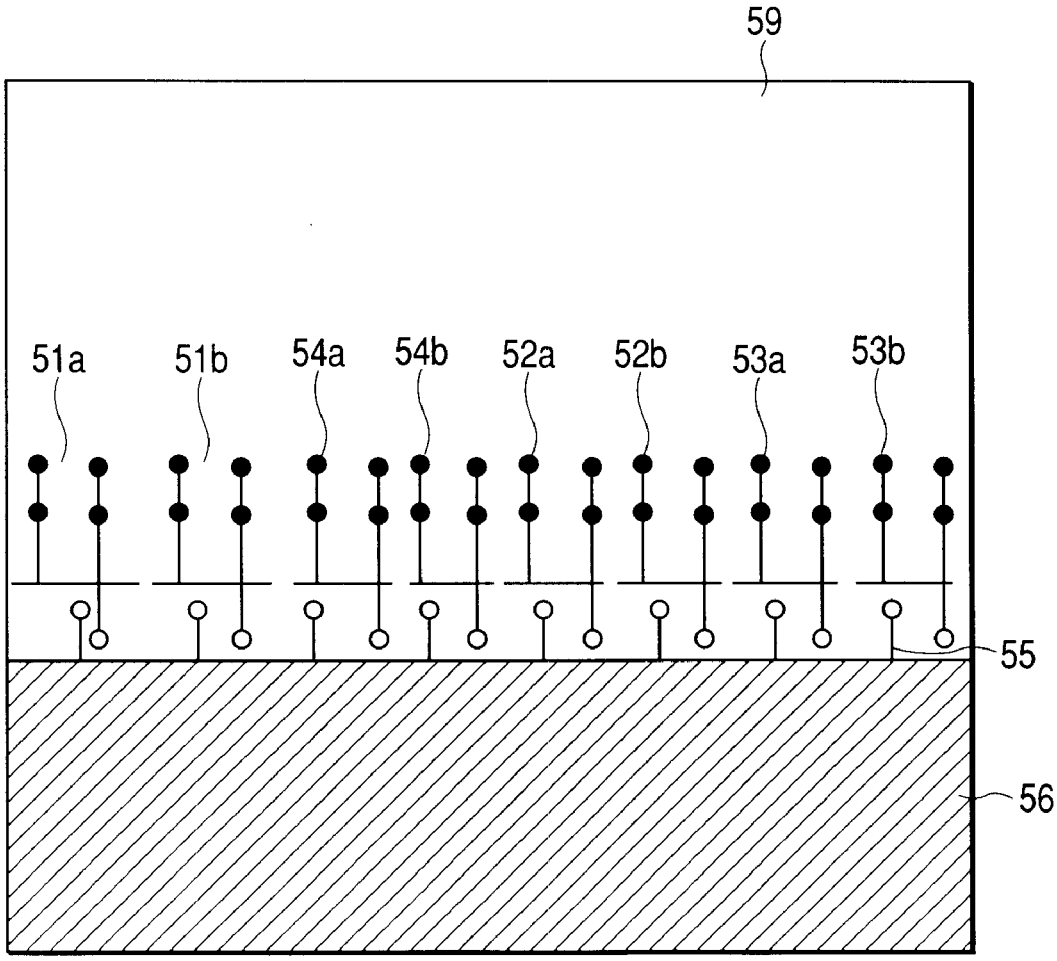
FIG. 11 is a conceptual view which shows the process in which the solvent in the coating layer is dried and removed to orientate the polymer of the surface modifying agent or the dissociated subdivided products for the adhesive fixation thereof on the surface.

Consequently, on the surface of the basis 56, the main skeleton portion having the surface energy substantially equal to the surface (interfacial) energy of this surface is orientated. Then, since the group 51-1 having the surface energy different from the surface energy of the basis 56 is in a state of being oriented to the outer side on the side opposite to the surface of the basis 56, a hydrophilic property is provided for the surface of the basis 56 if the group 51-1 is a hydrophilic group. The surface is modified in this manner. FIG. 11 is a view which shows the state of the hydrophilic processing agent and the surface of the basis being adsorbed subsequent to having coated and dried the hydrophilic processing liquid.

Figure 12:
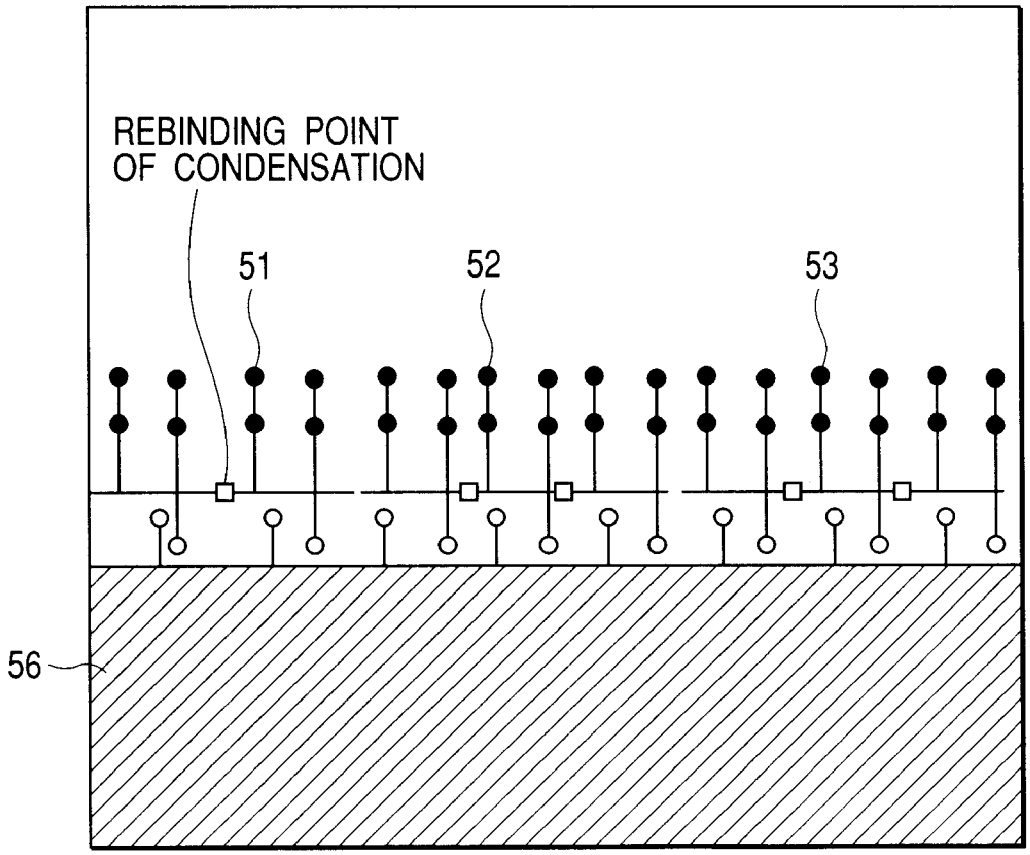
FIG. 12 is a conceptual view which shows the process of the dissociated subdivided products originated from the polymer of the surface modifying agent adhesively fixed to the surface being rebound with each other by the reaction of condensation.

In this respect, with polysiloxane or the like, which is capable of being bound at least in a part of subdivided products by the condensation of the subdivided products generated by cleavage, being used as polymer, for example, it becomes possible to generate binding between the subdivided products which are adsorbed to the surface of the basis 56. In this way, the covering film of hydrophilic processing agent can be made firmer still. When polysiloxane is used, there may occurs the phenomenon in which the hydrophilic processing agent is adsorbed more stably after having been adsorbed to the surface of basis by the siloxane portion, which is dissociated due to the highly concentrated acid, being rebound with moisture in the air by condensation. FIG. 12 is a view which schematically shows such rebinding with moisture in the air due to the condensational reaction. In this respect, the mechanism of polymerization by the formation and condensation of subdivided products by cleavage using polysiloxane is conceivably as given below.

In other words, along with the controlled drying of the surface processing liquid on the processing surface, the concentration of a dilute acid contained in the surface processing agent is increased to make it a concentrated acid. The concentrated acid ($H_2SO_4$, for example) cleaves the binding of polysiloxane and siloxane. As a result, the subdivided products of polysiloxane and silyl sulfuric acid are generated (scheme 1). Then, with further drying of the processing liquid existing on the processing surface, the concentration of subdivided products in the surface contact probability between the subdivided products themselves. Consequently, as shown in the scheme 2, the subdivided products themselves are condensed to reproduce the siloxane rebinding. Also, the silyl sulfuric acid, which is the by-product thereof, causes the methyl group thereof to be orientated toward the processing surface, too, if the processing surface is hydrophobic, and sulfone group is orientated in the direction different from the processing surface. In this manner, this conceivably contributes to the hydrophilic processing of the processing surface.

Scheme 1

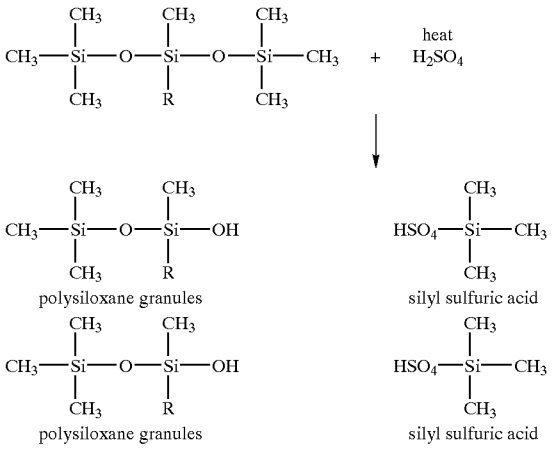

Scheme 2

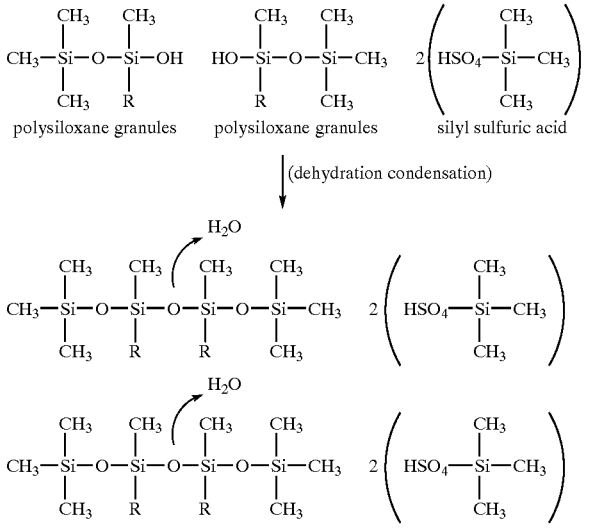

Figure 13:
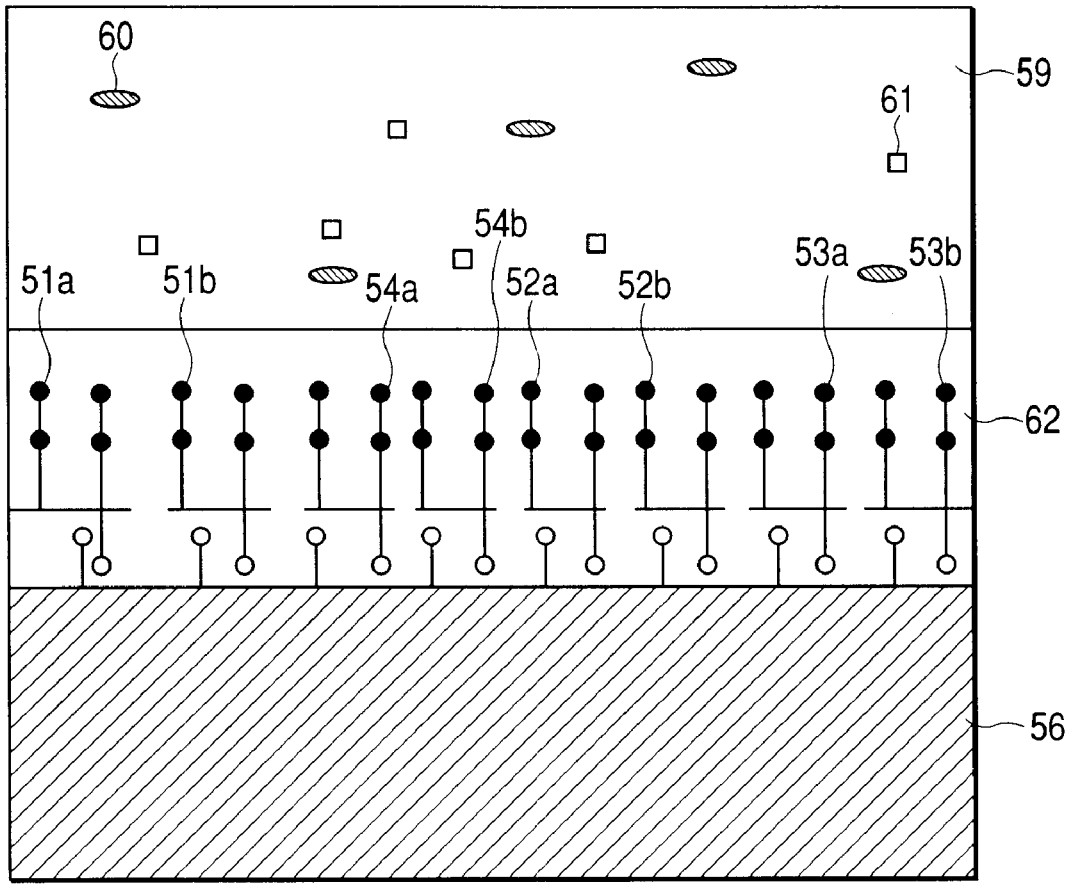
FIG. 13 is a conceptual view which shows the example of the surface modifying method of the present invention applied to a hydrophilic processing of a hydrophobic surface for the demonstration of the effect obtainable by adding water to a processing solution.

Here, FIG. 13 schematically shows one example of the state of a surface processing liquid in the case where a composition having the presence of water in a solvent is utilized as the surface processing liquid. When water exists in the solvent of a processing liquid, water and volatile organic solution are evaporated (gaseous molecule of water is indicated at 61, and gaseous molecule of organic solution, at 60) in the evaporation of solvent from the processing liquid used for the hydrophilic processing accompanied by heating. At this juncture, the evaporating speed of the volatile organic solution is faster than that of water. Then, the moisture concentration in the processing liquid becomes higher so that the surface tension of the processing liquid increases. As a result, difference in surface energy is generated on the interface of the processing surface of the basis 56 and the processing liquid. On the interface of the processing surface of the basis 56 and the processing liquid (moisture layer at 62) the moisture concentration of which has become higher, the portion of the basis, which has substantially the same or the same surface energy as that of the processing surface of the basis 56 in the subdivided products 51*a* to 54*b* from the polymer that serves as a hydrophilic processing agent, is orientated to the processing surface side of the basis 56. On the other hand, the portion, which has the hydrophilic group of the subdivided products from the polymer serving as the hydrophilic processing agent, is orientated to the moisture layer 62 side where the moisture concentration has become higher due to the evaporation of the organic solvent. Consequently, it is conceivable that the designated orientational capability of the polymeric subdivided products is enhanced still more.

Here, if the functional group is a polar group, it is possible to obtain color development or luminescence when the colorant or luminous agent, which react to this polar group to be adsorbed, is provided therefor.

As described above, in accordance with the present invention, it becomes possible to significantly enhance the range of desired characteristics, and there is no limit to the application thereof.

Also, in the case where the functional group has no relation with the desired characteristics, and the objective is to arrange polymer to be thin and uniform, it is only prerequisite for the functional group to provide the surface energy which is different from that of the group on the side to be adsorbed to the surface of the polymer. In this manner, the orientational property of the group is enhanced with respect to the portion having substantially the same or the same interfacial energy and surface energy. In this case, it is preferable to provide the mode in which at least the polymer is locally cleaved to deal with surface changes still more. Then, more preferably, the structure of subdivision after cleavage (monomer, dimer, trimer, or polymer of intermediate molecular weight) should be condensed or bridged so as to enable them to return to polymer of high molecular weight in order to enhance the close contactness.

In addition, the provision of this property for the entire circumference of the surface of element or for the entire surface thereof enables the surface of the structure of such element to present itself a strongly filmed condition, thus providing durability in a more preferable condition.

As described above, the application of the present invention to others is all possible as far as such application is attainable by use of the aforesaid mechanism of the invention, and it is to be understood that such application falls within the scope of the invention.

Particularly, with the polymer serving as the processing agent, which contains a wettability improver (isopropyl alcohol: IPA, for example) that improves wettability to provide the surface wettability of an element and a polymeric solvent; a medium that generates polymeric cleavage; and the group (or groups) the surface energy of which is substantially the same or the same as the partial surface energy of the surface of element, but is different interfacial energy between this group and any one of the aforesaid functional groups, the surface modification by condensation after cleavage can demonstrate excellent effects and reliably provide the uniformity and property, which have never been attained conventionally.

Figure 14:
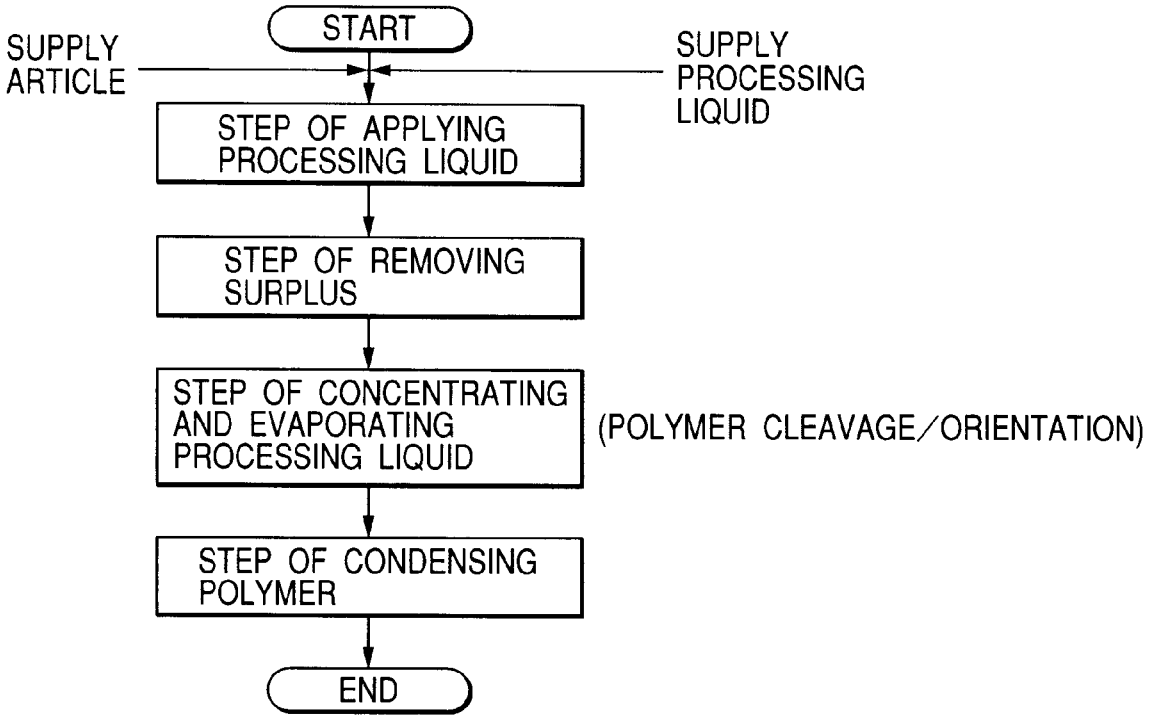
FIG. 14 is a view which shows one example of the manufacturing process of an element provided with the modified surface in accordance with the present invention.

FIG. 14 is a view which shows one example of steps in manufacturing each of these kinds of elements. When manufacture begins, an element and processing liquid are provided. Then, the element the surface of which has been modified can be obtained through the steps of applying the processing liquid to the surface of the element to be modified (to the modifying surface); removing any excessive portion from the modifying surface; condensing the processing liquid for the cleavage of polymer on the modifying surface, as well as for the orientation of subdivided products; and evaporating the processing liquid for the polymerization by binding between the subdivided products.

The processing condensation and evaporation steps are preferably possible at a temperature higher than the room temperature (60° C., for example) in a continuous process of heating and drying. When polysiloxane for modifying the surface which is formed by polyolefine resin is used together with water, acid, and organic solvent (isopropyl alcohol, for example), the processing period may be 45 minutes to 2 hours, for example. If isopropyl alcohol of 40 weight % is used, it is approximately one hour, for example.

Here, in the example shown in FIG. 14, the formation of subdivided products by the cleavage of polymer is made on the modifying surface of the element, but it may be possible to allow them to be orientated by supplying the processing liquid that has already contains subdivided products to the modifying surface of the element.

As the composition of processing liquid, it is possible to utilize the one which contains, as described earlier, the wettability improver, which is a good polymeric solvent having effective component as the surface improver, and also, a wettability applicable to the modifying surface for the enhancement of the wettability of the processing liquid with respect to the modifying surface; solvent; polymeric cleavage catalyst; polymer having the functional group that provides the modifying effect for the modifying surface and the group for obtaining the adhesive function to the recording surface.

Next, the description will be made of the specific example of a surface modification to provide hydrophilic property for the inner face of a liquid discharge head.

At first, the hydrophilic processing liquid is prepared with the composition shown in the following table 1:

TABLE 1

(Composition of hydrophilic processing liquid)

| Composition | Compounding Quantity (weight %) |
|---|---|
| (polyoxialkylene) · poly(dimethyl siloxane) | 4.0 |
| sulfuric acid | 0.5 |
| isopropyl alcohol | 95.5 |

Here, as the organic solvent alcohol, which is abundant of solubility of polymeric compound (polyoxialkylene) poly (dimethyl siloxane), isopropyl alcohol is used for preparation of the solution. At first, the sulfuric acid, which is an inorganic acid, is added to isopropyl alcohol so that the additive ration of the concentrated sulfuric acid becomes 0.5 weight % in the final solution, and mixed evenly to prepare the solution. Then, the aforesaid hydrophilic processing liquid is prepared by adding thereto (polyoxialkylene).poly (dimethyl siloxiane) so that the additive ration thereof becomes 4.0 weights in the final solution, and dissolved and mixed evenly. In this respect, the (polyoxialkylene).poly (dimethyl siloxiane) which used here is specifically expressed in the following general equation (1):

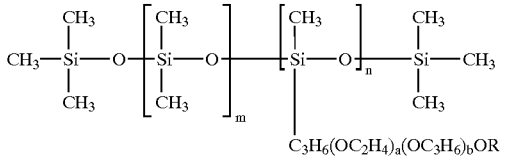

(1)

(where m, n designate positive integer; a, b, also positive integer; R, alkyl group or hydrogen), and structured in such a way that in the main repetitive unit of poly(dimethyl siloxiane), one of the methyl groups is replaced with the (polyoxialkylene) group. Here, the one available on the market (product name: Silwet L-7002 manufactured by Nihon Yunikah, K.K.) is used. In this respect, a small amount of water molecule is dissolved in addition to the sulfuric molecule along with the concentrated sulfuric acid for the aforesaid hydrophilic processing liquid.

Next, using the hydrophilic processing liquid the hydrophilic processing is attempted to be given to the inner face of a liquid discharge head. A small amount of the hydrophilic processing liquid thus prepared is provided for the inside of the liquid discharge head and wet the inner face thereof. After the inner face is uniformly wet, the liquid discharge head is swung to remove any excessive portion of hydrophilic processing liquid externally to the container. Then, the liquid discharge head the inner face of which is uniformly wet with the film of the hydrophilic processing liquid is dried in an oven at a temperature of 60° C. for one hour for the manufacture thereof.

Here, in the hydrophilic processing method, the hydrophilic processing liquid adheres to the orifice plate surface where the discharge ports of the liquid discharge head are open. Thus, there is a fear that a hydrophilic processing film is also formed thereon. There is also a fear that a part of discharged ink, which becomes mist in the liquid discharge apparatus, adheres to the orifice surface. If ink adheres to the orifice surface, ink is pulled by the ink that has adhered thereto, and an unfavorable influence is exerted on the discharging direction of ink or the like. Usually, therefore, with a method for providing a water-repellent film for the orifice surface or the like, a water-repellent processing is given thereto.

In the hydrophilic processing method, such water-repellent film is not affected by the hydrophilic film thus formed thereon so as not to be chemically changed. Therefore, the hydrophilic processing film which has been formed on the water-repellent film is cut off by the laser irradiation or blade cleaning to enable the water-repellent film to be exposed, thus recovering the water-repellency of the orifice surface easily.

As described above, in accordance with the present invention, the inner face of the portion where liquid is filled, such as the common liquid chamber and the liquid flow path, among some others, is given hydrophilic processing, hence uniformalizing the surface energy of the inner face to make it possible to fill in liquid in good condition, and provide the liquid discharge head which is excellent in reliability.

More specifically, for the liquid discharge head which is formed by bonding plural members, the difference in the surface energy of each of plural members is equalized, and particularly, the hydrorepellency, which is brought about by the bonding agent or sealant used for bonding them, is eliminated in order to suppress the creation of the portions where air accumulation tends to occur on the inner face of a liquid discharge head.

Further, in accordance with the hydrophilic processing method of the present invention applicable to a liquid discharge head, it is possible to suppress the generation of eluted substance that may take place in the liquid discharge head in some cases. Also, with the hydrophilic processing method thus applicable to the liquid discharge head, the hydrophilic processing film is formed on the inner face of the liquid discharge head by the thin film polymer of molecular level, hence making it possible to effectuate the hydrophilic processing without changing the inner structure of the liquid discharge head and the size thereof essentially.

What is claimed is:

1. A liquid discharge head for recording by discharging recording liquid, said liquid discharge head comprising:

a surface formed at least on a part of an inner face of said liquid discharging head, the inner face being in contact with the recording liquid, wherein a polymer is applied to said surface, the polymer comprising: (1) a first portion having a lyophilic group for lyophilic processing, and (2) a second portion having a group with substantially the same, or the same, interfacial energy as a surface energy of said surface, but different from an interfacial eneregy of the lyophilic group, wherein the second portion of the polymer is oriented toward said surface, and the first portion of the polymer is orientated away from said surface, and wherein the polymer is subdivided with a catalyst for a polymeric cleavage prior to being applied to said surface by binding the subdivided polymers.

2. A liquid discharge head according to claim 1, wherein a portion of said liquid discharge head filled with the recording liquid is formed by bonding a plurality of members.

3. A liquid discharge head according to claim 2, wherein the plurality of members are bonded by a bonding agent or sealant.

4. A liquid discharge head according to claim 3, wherein the bonding agent or the sealant is silicon material or epoxy material.

5. A liquid discharge head according to claim 1, wherein at least parts of the plurality of members themselves are formed by materials having different surface energy from each other.

6. A liquid discharge head according to claim 1, wherein the plurality of members include: (1) a base plate having discharge energy generating members for generating energy for discharging the recording liquid; (2) a ceiling plate bonded to the base plate with grooves formed on the bonded face to constitute liquid flow paths, the liquid flow paths being communicated with discharge ports for discharging the recording liquid, and the recording liquid being passed through the liquid flow paths above the discharge energy generating members; and (3) an orifice plate having the discharge ports, the orifice plate being bonded to the base plate and the ceiling plate to enable the discharge ports to be communicated with the liquid flow paths.

7. A liquid discharge head according to claim 1, wherein the plurality of members include: (1) a base plate having discharge energy generating members for generating energy for discharging the recording liquid; and (2) a ceiling plate bonded to the base plate with grooves formed on the bonded face to constitute liquid flow paths, the liquid flow paths being communicated with discharge ports for discharging the recording liquid, and the recording liquid being passed through the liquid flow paths above the discharge energy generating members.

8. A liquid discharge head according to claim 6, wherein the ceiling plate or the orifice plate is formed by resin material containing polysulfone or epoxy.

9. A liquid discharge head for recording by discharging recording liquid comprising a hydrophobic surface forming at least a part of an inner face of said liquid discharge head, said hydrophobic surface having the recording liquid in contact therewith and being modified to be a hydrophilic surface, wherein subdivided products having a hydrophilic group and a hydrophobic group are generated by cleaving a polymeric compound, the polymeric compound having the hydrophilic group and the hydrophobic group, and wherein the hydrophobic group is oriented toward said hydrophobic surface to adhere to said hydrophobic surface, and the hydrophilic group is oriented in a direction different from the hydrophobic group.

* * * * *

UNITED STATES PATENT AND TRADEMARK OFFICE

CERTIFICATE OF CORRECTION

PATENT NO. : 6,623,102 B2
DATED : September 23, 2003
INVENTOR(S) : Mikio Sanada et al.

It is certified that error appears in the above-identified patent and that said Letters Patent is hereby corrected as shown below:

Column 7,
Line 58, “thereof” should read -- thereof. --.

Column 9,
Line 20, “la;” should read -- 1a; --.

Column 12,
Line 2, “soften” should read -- softened --.

Column 13,
Line 34, “utilize” should read -- utilizing --.

Column 15,
Line 12, “an” should read -- a --.

Column 16,
Line 13, “substitutional” should read -- substitutionally --.

Column 17,
Line 13, “occurs” should read -- occur --.

Column 19,
Line 60, “has already” should read -- already --.

Column 20,
Line 21, “(polyoxialkylene) poly” should read -- (polyoxialkylene)•poly --.
Line 30, “weights” should read -- weight% --.

Signed and Sealed this

Third Day of February, 2004

JON W. DUDAS
*Acting Director of the United States Patent and Trademark Office*